US006937151B1

(12) United States Patent
Tapanes

(10) Patent No.: US 6,937,151 B1
(45) Date of Patent: Aug. 30, 2005

(54) METHOD OF PERIMETER BARRIER MONITORING AND SYSTEMS FORMED FOR THAT PURPOSE

(75) Inventor: Edward E Tapanes, Glen Waverley (AU)

(73) Assignee: Future Fibre Technologies Pty Ltd, Rowvill Vic (AU)

( * ) Notice: Subject to any disclaimer, the term of this patent is extended or adjusted under 35 U.S.C. 154(b) by 193 days.

(21) Appl. No.: 10/130,900

(22) PCT Filed: Oct. 30, 2000

(86) PCT No.: PCT/AU00/01332

§ 371 (c)(1),
(2), (4) Date: May 23, 2002

(87) PCT Pub. No.: WO01/39148

PCT Pub. Date: May 31, 2001

(30) Foreign Application Priority Data

Nov. 24, 1999 (AU) ..... PQ4206

(51) Int. Cl.[7] ..... G08B 13/00
(52) U.S. Cl. ..... 340/550; 250/227.19; 340/555
(58) Field of Search ..... 340/541, 550, 340/555, 556, 557, 565, 566; 385/12, 13; 250/227.19, 227.14

(56) References Cited

U.S. PATENT DOCUMENTS 4,292,628 A 9/1981 Sadler
4,931,771 A 6/1990 Kahn
5,144,689 A * 9/1992 Lovely ..... 385/12
5,416,467 A 5/1995 Ohta et al.
5,434,557 A * 7/1995 Alizi ..... 340/555
5,448,222 A * 9/1995 Harman ..... 340/566
5,461,364 A * 10/1995 Sanford et al. ..... 340/541
5,592,149 A * 1/1997 Alizi ..... 340/550
5,680,104 A 10/1997 Slemon et al.
6,646,551 B2 * 11/2003 Perry ..... 340/564

FOREIGN PATENT DOCUMENTS

DE 296 10 453 U1 10/1996
GB 2 258 553 2/1993
WO WO 94/18649 8/1994

* cited by examiner

*Primary Examiner*—Thomas Mullen
(74) *Attorney, Agent, or Firm*—Senniger Powers

(57) ABSTRACT

A perimeter barrier system and method of monitoring a perimeter barrier are disclosed which comprise a perimeter barrier element in the form of a picket or fence panel which is mounted for limited movement by spring loading the barrier element by means of springs. An optical fiber is coupled to the barrier elements so that upon an attempt to breach the perimeter barrier system the barrier element is moved to in turn cause movement of the waveguide. A light source and detector is provided for launching light into the fiber and for detecting light which is passed through the fiber so that when the fiber is moved a parameter of the light is changed and that change in parameter is detected by detector to provide an indication of an attempt to breach the perimeter barrier system.

20 Claims, 14 Drawing Sheets

Figure 12
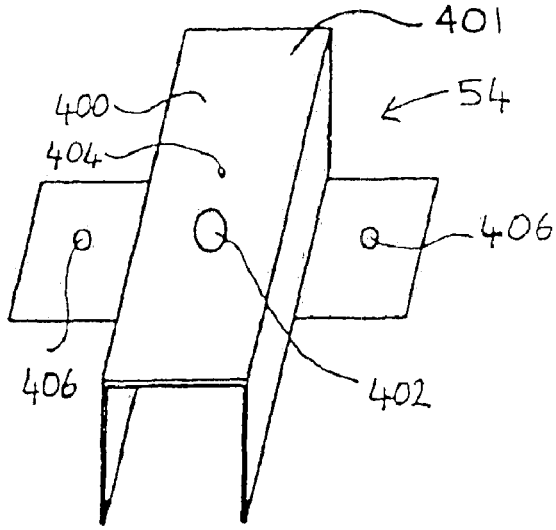
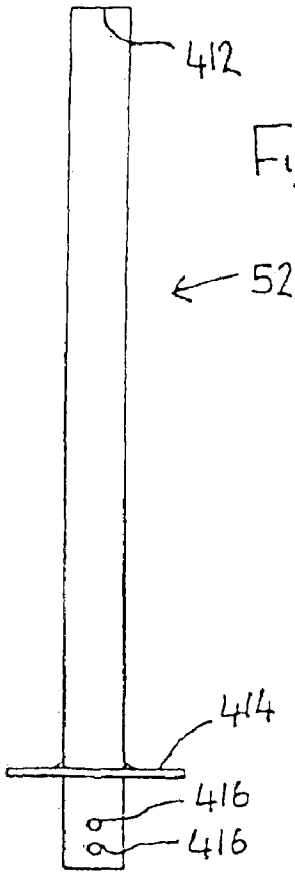
Figure 13a
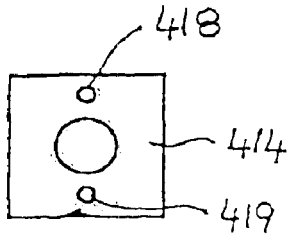
Figure 13b

METHOD OF PERIMETER BARRIER MONITORING AND SYSTEMS FORMED FOR THAT PURPOSE

FIELD OF THE INVENTION

This invention relates to a method and systems formed for monitoring a perimeter barrier against intrusion or tampering utilising fibre optic sensing technology.

The perimeter monitoring systems according to this invention are unique and offer new methodologies never before commercially available for perimeter monitoring. Furthermore, they pose many operational and cost advantages, offering ease of sensor installation, increased sensitivity and coverage, excellent potential for system automation and reduction in the required installation, operational and maintenance costs.

ART BACKGROUND

A major issue for security service providers is to be able to have confidence in the integrity of the monitoring systems at their disposal. They require reliable systems that are rugged and can operate effectively for years of field operation, and yet are not prone to false alarms under a wide variety of operational and environmental conditions.

Intrusion detection systems are widely employed to secure a large variety of sites, from low-security private residences to high-security military installations. Most of the systems available comprise a physical barrier and an electronic detection capability.

The most widely used conventional systems utilise the following technologies:

CCTV cameras

Taut-wire fences

Leaky wave coax cables

E-field sensors

Microphonic cables

Strain gauged systems

X-band line-of-sight radar beams

Free-space infrared surveillance equipment

A major limitation for many conventional perimeter security systems is their susceptibility to electromagnetic interference and their inability to operate reliably over long distances. Furthermore, their costs usually increase significantly as the length of a protected perimeter increases.

Traditional perimeter security systems attempt to overcome their distance limitations through the use of multiple, contiguous zones covering the full extent of a perimeter. Generally, this zoning can assist in supporting other distance-limited security devices such as video cameras and lighting for monitoring suspected breach attempts.

In many cases, with traditional systems, these zones can be limited in length to as low as one to three hundred meters. With industrial sites often having perimeters in excess of two kilometres, there may be a requirement for at least six to twenty zones in such cases. Government and military sites can be considerably larger.

Furthermore, with traditional systems there is generally a need to install zone controller electronics each time a new zone is required. Consequently, for systems with large numbers of zones the cost can become prohibitive. In addition, there is a significant increase in reliability issues and potential maintenance costs as the incidence of perimeter-mounted electronics increases. In particular, lightning strikes, a common occurrence for steel fences, can easily disable many zones in the one hit where external electronics are involved.

All these limitations of active perimeter monitoring systems can be overcome with an optical fibre based sensing system. The inventions disclosed in this specification relate to a method and systems formed for monitoring a perimeter barrier against intrusion or tampering utilizing fibre optic sensing technology.

This is possible because optical fibres can be more than mere signal carriers. Light that is launched into and confined to the fibre core propagates along the length of the fibre unperturbed unless acted upon by an external influence. In a sensing application, the optical fibre should be installed such that the disturbing influence is coupled from the structure of interest to the fibre, thus altering some characteristic of the light within the fibre.

Specialised sensing instrumentation may be configured such that any disturbance of the fibre which alters some of the characteristics of the guided light (ie., amplitude, phase, wavelength, polarisation, modal distribution and time-of-flight) can be monitored, and related to the magnitude of the disturbing influence. Such modulation of the light makes possible the measurement of a wide range of events and conditions, including:

strain displacement cracking vibration/frequency impact acoustic emission temperature load Fibre optic sensor (FOS) technology has progressed at a rapid pace over the last decade. Different configurations of fibre sensing devices have been developed for monitoring specific parameters, each differing by the principle of light modulation. Fibre optic sensors may be intrinsic or extrinsic, depending on whether the fibre is the sensing element or the information carrier, respectively. They are designated "point" sensors when the sensing gauge length is localised to discrete regions. If the sensor is capable of sensing a measured field continuously over its entire length, it is known as a "distributed" sensor; "Quasi-distributed" sensors utilise point sensors at various locations along the fibre length. Fibre optic sensors can be transmissive or can be used in a reflective configuration by mirroring the fibre end-face.

Hence, fibre optic sensors are actually a class of sensing device. They are not limited to a single configuration and operation unlike many conventional sensors such as electrical strain gauges and piezoelectric transducers.

Furthermore, FOS technology has many advantages over conventional sensing devices because of its high resolution and its ability to work in real-time, without electromagnetic interference problems. Furthermore, sensor lengths can vary between different devices; from point sensing configurations to very long sensing configurations (over 50 km long). In addition, they are made from a very durable material that is corrosion resistant (pure silica).

Consequently, fibres are now replacing the role of conventional electrical devices in sensing applications to the extent where we are now seeing a multitude of sensing techniques and applications being explored for practical gain, including in the perimeter security field. Using the latest technology in fibre optic sensing it is now possible to secure many types of perimeters, fences and barriers.

Fibre optic cables, when used as sensors, can be applied to fences, walls, rooftops, or air-conditioning ducts, or they can be buried in gravel or under lawns. They can be used for the protection of buried pipelines, prisons, government buildings, defence sites, chemical laboratories, power plants, pumping stations, embassies, airports, secure residential complexes, manufacturing plants, storage facilities, communications facilities, harbours and even international borders.

One particular benefit of fibre optic based systems is their immunity to electrical interference, particularly important for installations near high voltage electrical equipment, high power radio transmissions or in areas subject to lightening strikes.

As a result, considerable research has been underway over the past decade into the development of fibre optic perimeter monitoring systems. Previous research in this area involved the use of the following fibre optic sensing techniques:

1. Bistable Techniques:

The bistable fibre optic sensor is the simplest form of sensor, detecting damage or other interruption by the absence of light in a fibre. This technique usually requires the physical fracture of the fibre which is detected by a photodiode as an intensity loss or null.

2. Optical Time Domain Reflectometry (OTDR) Techniques:

The basis of OTDR is essentially optical radar. A narrow optical pulse from a laser is launched into a multimode (usually) fibre and the light backscattered due to optical inhomogeneities is used to determine the attenuation properties of the optical fibre along it's entire length. The attenuation is characterised by analysing the time dependence of the detected Rayleigh backscattered light.

OTDR techniques allow for distributed sensing and are capable of detecting stress, strain, temperature, electric and magnetic fields, and mechanical faults along the entire length of the fibre. OTDR can be used to detect and locate breaks in a fibre due to Fresnel reflection at the fracture. OTDR can be a very useful tool for detecting and locating the above listed parameters but the long signal integration times needed to obtain reasonable signal-to-noise ratios limits this technique to detecting permanent, usually destructive, effects on the fibre cable.

3. Modalmetric Multimode Techniques:

This optical fibre sensing technique is based on the modulation in the distribution of modal energy propagated in a fibre. Although this type of sensor can be effective, the modulation of the modal pattern is generally non-linearly related to all disturbances, resulting in deep fading and drifting of the output signal. This behaviour generally limits the use of this sensor for quantitative strain measurements, but nonetheless it can be used as a threshold-type sensor. Modalmetric sensors are capable of sensing many parameters, however, their sensitivities are generally lower than interferometric sensors and localisation of the sensing region is difficult (resulting in sensitive leads). However, for security applications the modalmetric sensors offer the advantage of detecting disturbances over long lengths of fibre (they are generally a distributed sensor).

However, in 1994 the present applicant developed a novel distributed fibre optic vibration sensing technology (see PCT specification PCT/AU95/00568). The sensing technique was based on a unique fibre optic modalmetric sensor configuration. This sensor provides a simple, effective and inexpensive technique to detect and characterise both small and large, static and dynamic disturbances on any optical fibre cable, anywhere along its entire length in a non-intrusive way, directly and in real-time. This sensing technique is based on the modulation of the modal distribution in a multimode optical fibre by external disturbances. This technique overcomes the inherent weaknesses of most multimode fibre optic sensors, offering mechanically stable and linear sensing. In this method, the sensor response is a direct function of the disturbance on the sensitised portion of the fibre, regardless of where the disturbance occurs along the length. The disturbance may be in the form of physical movement (ie., compression (radially or axially), elongation, twisting, vibration, etc.) or microphonic effects (ie., travelling stress waves or acoustic emissions). This sensor had a further advantage over most other modalmetric sensors in that it can operate as a single-ended device by mirroring the fibre end-face.

4. Periodic Microbending Techniques:

In this technique, when a fibre is bent the light propagating in the core is coupled into the cladding and lost. The smaller the radius of curvature of the bend the higher the loss of radiation. This principle is the basis of the periodic microbend sensor. Thus, the transmission of the optical fibre is reduced by applying a periodic force on the fibre. Maximum transmission loss occurs when the bending is applied periodically with a specific bend pitch. Consequently, this technique requires a specially designed clamp to apply pressure to the fibre at the point of interest. Therefore, it is not a distributed technique, although a large number of clamps can be installed along the fibre length for quasi-distributed operation. The advantages of this technique are in its response repeatability.

5. Interferometric Techniques:

Interferometric fibre optic sensors are a large class of extremely sensitive fibre optic sensors. Fibre optic interferometers are analogous to their respective classic bulk optic interferometers. Fibre optic interferometers are generally intrinsic sensors in which light from a coherent source is equally divided to follow two (or more) fibre-guided paths. The beams are then recombined to mix coherently and form a "fringe pattern" which is directly related to the optical phase difference experienced between the different optical beams. This sensing technique is based primarily on detecting the optical phase change induced in the radiation field as it propagates along the optical fibre.

Fibre optic interferometers are typically used when ultra-high sensitivities are required and/or in applications of localised measurements (ie., point sensing), although sensor lengths longer than one meter are sometimes possible. Interferometers configured in a Mach-Zehnder or Sagnac configuration, however, enable truly distributed sensing to be performed. Furthermore, the Sagnac configuration makes it possible to locate a disturbance on the fibre system. Ultimately, the sensitivity and resolution of interferometers are limited by the effectiveness of the phase demodulation signal processing techniques used to interrogate the sensors.

The first types of fibre optic systems used for perimeter intrusion detection were based on destructive means, ie., the system relied on the optical fibre being cut, broken or severely bent in order to detect an event. Sometimes, these utilised OTDR to attempt to locate the events. These systems were found ineffective and inconvenient.

Truly modalmetric sensing systems, such as the Sabre-Fonic from Pilkington P.E. Limited (UK) and Remsdaq Limited (UK), utilised the first non-destructive methods for perimeter monitoring. However, owing to the modulation of the modal pattern being non-linearly related to all disturbances, this method suffers from deep signal fading and drifting, resulting in many false alarms. For example, if the sun came out from behind clouds and suddenly warmed the fibre cable, the system response could be comparable or greater than the response from a true intrusion attempt. Consequently, this method suffers major problems from environmental conditions and is generally viewed as being quite unreliable.

In more recent years, advances in modalmetric techniques resulted in linear, more reliable systems, such as the Fiber Defender 200 Series (particularly the FD-220) from Fiber SenSys Inc. (USA) and the Foptic™ Secure Fence (FOSF™ from Future Fibre Technologies Pty. Ltd. (Australia).

The first system to be commercially available, the FD-220, offered considerable response and operational improvements from all previous systems. However, it still suffered from a number of limitations, as follows:

(a) According to promotional material, the maximum sensing length is limited to 1,000 to 2,000 meters. However, feedback from the industry is that the effective range is only 200 m.

(b) The system equipment for each zone needs to be mounted on the fence being monitored. This requires power to be provided externally to each system and results in a vulnerability to electromagnetic interference and lightning strikes. Furthermore, since the relatively short sensing range of the system requires a perimeter to be broken-down into a large number of zones for long perimeters, the system can be complex, expensive and subject to high maintenance requirements.

(c) It cannot pin-point the location of the disturbance.

On the other hand, the FOSF™ is ideally suited to longer distance perimeters because of the nature of the unique sensing technique it employs. The FOSF™ can operate reliably over many tens of kilometres and theoretically over distances greater than two hundred kilometres. It can be operated as a single zone system using the Locator capability developed by Future Fibre Technologies Pty. Ltd. to identify any point of attempted intrusion, or it can be operated as a zoned system with zones of any desired length. A most important aspect of the FOSF™ configuration, zoned or using the Locator capability, is that no external electronics, optics or control hardware are required.

Currently, there is only one system employing the periodic microbending technique, the Inno-Fence from Magal Security Systems Limited (Israel). This system is based on a reliable sensing technique, but the requirement to clamp the fibre can lead to potential maintenance issues and the induced loss of light can severely limit the sensing range of the technique. Furthermore, the mechanical configuration of the system is quite limited and complex due to the need for the large number of clamping devices needed to cover the fibre length of interest. Consequently, this system is designed to monitor entire sections of panels in a picket-type fence configuration.

Interferometric fibre optic sensors, although offering very high sensitivity, and the ability to locate using a Sagnac configuration, are yet to offer an effective commercially available system to-date. This may be due to the very high sensitivity making the sensing device too sensitive/susceptible to environmental conditions and disturbances.

All but one of the above mentioned systems can be applied to virtually any type of perimeter barrier or fence, as well as being embedded in the ground. They can be used to protect such fence types as steel mesh and palisade, simply by attaching the fibre in a suitable manner to the fence. Most systems in use are based on these techniques.

However, the Inno-Fence system from Magal Security Systems Limited (Israel) is largely restricted to monitoring the panels situated between posts in a picket-type perimeter fence arrangement. This restriction stems from the requirement to incorporate the fibre clamping devices in the fence structure so that they are not visible and vulnerable to tampering. This had lead Magal to design quite a complex mechanical arrangement for the Inno-Fence system. Sensitivity of the system is to disturbance of the panel, not so much to each individual picket, because of the limited number of clamping devices and certain practical limitations to the physical configuration of the fence panel. These limitations and restrictions of the system results in problems with often inadequate sensitivity, the capability to overcome detection and quite serious maintenance issues.

Consequently, present inventor investigated and developed completely new methods for monitoring a perimeter barrier against intrusion or tampering utilizing the novel distributed fibre optic vibration sensing configuration detailed above. The novel distributed vibration sensing technique provides a fibre sensor which is highly sensitive to movement, displacement, loading and/or vibration of the fibre at any finite point along its length and does not require any particular physical configuration or fibre disturbing/clamping device to register an event. Consequently, much more convenient, effective, lower cost and aesthetic configurations for a picket-style fence are possible using this technique compared with what is available in the prior-art. The outcomes of this work are contained and claimed in this specification.

The main innovative features contained in the inventions disclosed in this specification are:

The systems operate using a novel distributed fibre optic vibration sensing technology or any other suitable, intrinsic distributed fibre optic sensor capable of detecting displacement, movement, loading and/or vibration of the optical fibre.

Each individual picket of the fence is attached to the distributed fibre optic vibration sensor and is thus sensitive to movement or physical disturbance.

A crossbar is not necessary to use with the pickets, although it is still possible to have one.

Movement sensitive panels can still be configured and utilised, with either the pickets or the supportive members instrumented to detect movement or physical disturbance.

The pickets or panels may be positioned between posts, or free-standing as in a palisade fence.

The monitoring systems are microprocessor based, situated in a central controls/alarm room and fully automated, providing real-time data analysis, logging and alarming features, and can be monitored and controlled locally or remotely.

Direct discussions with the industry have verified that there is very good commercial potential for the disclosed inventions and that there are clear advantages over the prior-art. It is important to note that the technology is considered to have good potential over competing techniques particularly because of the ease of sensor installation, the increased sensitivity and coverage, the excellent potential for system automation (ie., using cameras and remote communications) and the reduction in the required installation, operational and maintenance costs. Therefore, the inventions disclosed in this specification potentially offer lower cost products with enhanced capabilities and features.

BRIEF SUMMARY OF THE INVENTION

The object of the present invention is to provide a method and systems formed for monitoring a perimeter barrier against intrusion or tampering.

The invention provides a perimeter barrier system including:

a barrier element;

mounting means for mounting the barrier element for limited movement;

a waveguide located in proximity to the barrier element;

a light source for launching light into the waveguide so that the light can travel through the waveguide;

a detector for detecting light which has travelled through the waveguide; and wherein upon disturbance of the barrier element caused by an attempt to breach the perimeter barrier system, the barrier element moves because of its mounting within the mounting means to cause a movement or loading of the waveguide which alters a parameter of the light travelling through the waveguide, and whereupon the detector detects the changing parameter of the light which has travelled through the waveguide to thereby provide an indication of an attempted breach of the perimeter barrier system.

The invention provides a method of monitoring a perimeter barrier system to determine an attempt to breach the perimeter barrier system, including:

mounting barrier elements of the perimeter barrier system for limited movement;

providing a waveguide in proximity to the barrier elements so that movement of the barrier elements upon an attempt to breach the barrier element causes movement or loading of the waveguide;

launching light into the waveguide;

detecting light which is passed through the waveguide; and processing the detected light to determine whether there is a change in parameter of the light indicative of movement of the waveguide which in turn is indicative of movement of one of the barrier elements to thereby provide an indication of an attempted breach of the perimeter barrier system.

The preferred embodiments of the present invention rely on the use of a distributed fibre optic vibration sensor or any other suitable, intrinsic distributed fibre optic sensor capable of detecting displacement, movement, loading and/or vibration of an optical fibre suitably attached to each individual picket or panel of a fence, thus detecting and monitoring all movement or physical disturbance to the fence. The key feature is the sensitivity of each picket or panel of the fence and the mechanisms to achieve this.

In other embodiments, any other suitable type of sensors or sensing devices, distributed or point sensitive, are suitably attached to each individual picket or panel of a fence, thus detecting and monitoring all movement or physical disturbance to the fence. The key feature is the sensitivity of each picket or panel of the fence and the mechanisms to achieve this, as illustrated in the figures.

The preferred embodiment of the present invention provides a method and systems formed for monitoring a perimeter barrier against intrusion or tampering utilising fibre optic sensing technology, which may comprise the steps of:

providing a distributed physical disturbance sensing device in the form of a distributed fibre optic vibration sensor as the sensing device configured in a suitable arrangement that responds to the physical disturbance applied by an object, such as a person, as it physically disturbs the monitored pickets or panels of the fence;

providing a silica waveguide (single or multi moded) for receiving light from the sensing device instrumentation, the silica waveguide being capable of transmitting the sensing signal in the required manner along its length, but particularly such that the sensing wavelength and the waveguide characteristics satisfy the requirements of the modalmetric, distributed fibre optic vibration sensing and locating techniques described earlier;

providing detector means for detecting the sensing signal;

if required, providing detector means for detecting the counter-propagating sensing optical signals effected by the same parameter and for determining the time delay or difference between the signals in order to determine the location of the sensed event;

providing instrumentation associated with the sensing device having output signals associated with the magnitudes and frequencies of the detected physical disturbance to the sensing device;

providing automated system instrumentation which accepts the information from the sensing device instrumentation and suitably analyses, records, alarms, displays and transmits the information;

optionally, calibrating the installed sensing device by a suitable process involving disturbing the instrumented pickets or panels a number of times, varying the disturbance a number of ways, to establish statistically derived calibration factors for the monitored perimeter;

acquiring the output signal from the sensing device in a continuous configuration or a number of output signals from various sensing devices in a zoned perimeter configuration as a physical disturbance impinges on the instrumented pickets or panels of the monitored perimeter;

optionally, utilising the methodology developed by the applicant of this specification for locating events with the distributed fibre optic vibration sensor to actually pin-point the location of the physical disturbance to the monitored perimeter;

analysing the signal characteristics using suitable algorithms, taking into account any site calibration factors, so as to determine the likelihood of the detected event being an attempted intrusion or tampering of the perimeter barrier of the monitored perimeter and determining whether to raise an alarm; and recording the detected information and alarm results in a monitoring system and displaying or transmitting the desired information locally and/or remotely.

Furthermore, the preferred embodiment of the present invention provides a method for installing a distributed movement sensitive fibre optic sensing device to a number or all of the individual pickets or panels of a fence to be monitored, which may comprise the steps of: preparing the site for the instrumented perimeter fence installation, or if a fence already exists preparing the existing fence infrastructure for the installation of the instrumented pickets or panels;

producing a suitable mechanical configuration or arrangement for a picket or panel fence such that physical disturbance of the monitored pickets or panels of the fence produces suitable movement of the pickets or panels; suitably attaching the distributed fibre optic vibration sensor(s) to each desired fence picket or panel in such a way that the sensing fibres are not visible or readily susceptible to tampering;

protecting the sensor leads in a suitable manner, possibly running them in conduits to the sensing device instrumentation; and completing and restoring site works, rendering the monitoring and lead fibres practically invisible.

In the method, according to the preferred embodiment of the invention, electromagnetic radiation at a sensing wavelength is launched into an optical waveguide (single or multi moded), such as an optical fibre, from a light source, such as a pigtailed laser diode, and propagates along the optical waveguide. The optical waveguide is fusion spliced, or otherwise connected (temporarily or permanently), to one input arm of a suitable optical waveguide isolator and when the electromagnetic radiation reaches the isolator the electromagnetic radiation can only propagate out into the output waveguide arm of the isolator. The electromagnetic radiation cannot propagate in the reverse direction through the isolator, thus optical reflections are stopped from possibly destabilising the laser diode. The output waveguide arm of the isolator is then fusion spliced, or otherwise connected (temporarily or permanently), to one input arm of an optical waveguide light splitter or coupler (single or multi moded) and when the electromagnetic radiation reaches the coupler the electromagnetic radiation can branch out into the output waveguide arm of the coupler.

If a coupler with two output arms is used then the unused arm is fractured or otherwise terminated to avoid back-reflections. The output arm of the coupler is fusion spliced, or otherwise connected (temporarily or permanently), directly to the main sensing waveguide, which is multimoded for the sensing signal. The sensing signal propagates along the entire length of the waveguide until it reaches the opposite end of the sensing waveguide. The end-face of the sensing waveguide is suitably terminated with a mirror so that the sensing signal is efficiently reflected at the mirror and launched back into the coupler. The sensing waveguide is the part of the waveguide sensor that should be exposed to the sensing region of interest (ie., attached to the desired fence pickets or panels). The sensing signal is then branched out into two separate output arms of the coupler (in the opposite direction to the original light input). Electromagnetic radiation that propagates in the coupler arm towards the isolator and light source is attenuated by the isolator and prevented from being launched into the laser diode. The other output arm of the coupler is then terminated at an appropriate photodetector. Appropriate electronics, signal processing schemes and algorithms process the signals from the photodetector to obtain the desired information. The sensing waveguide, which is capable of detecting displacement, movement, loading and/or vibration, is suitably attached to a number or all of the individual pickets or panels of a fence, thus detecting and monitoring all movement or physical disturbance to the fence. The sensing system then analyses the signal characteristics using suitable algorithms, taking into account any site calibration factors, so as to determine the likelihood of the detected event being an attempted intrusion or tampering of the perimeter barrier of the monitored perimeter and determining whether to raise an alarm.

The preferred embodiment of the present invention further incorporates a data logger in the system instrumentation, which consists of a number of optoelectronic and/or electronic cards housed in an instrument enclosure. Several distributed sensing device inputs can be provided, as required to cover the perimeter with the desired number of monitored zones. The data logger captures the information provided by the distributed sensing devices and stores any desirable information, along with the date/time, into the data logger's internal memory. The information may also be available in real-time to allow the system to be monitored and alarmed on-site, as required. In a preferred embodiment of the invention, a network connection is provided or a modem is connected to the system to provide remote data downloading, monitoring or alarming capabilities. The sensing system functionality allows local or remote monitoring of the instrumented site.

The waveguide or waveguides may be formed from any glass material, hard oxides, halides, crystals, sol-gel glass or polymeric material, or may be any form of monolithic substrate.

In a preferred embodiment the silica waveguide is a multimoded fibre at the sensing wavelength and the lead waveguides are singlemode fibres at the sensing wavelength.

In a preferred embodiment, but without limitation, the distributed sensing technique is based on a modalmetric distributed fibre optic vibration sensor technique.

In a preferred embodiment, but without limitation, the distributed fibre optic vibration sensor is operated in a reflective configuration by mirroring the end-face of the sensing fibre, as described above, with the optical source, detector and other suitable optical components at the same end of the sensing fibre. In another embodiment, the distributed fibre optic vibration sensor is operated in a transmissive configuration, with the optical source and detector at opposite ends of the sensing fibre.

A preferred method for mirroring the optical fibre end-face involves placing a prepared fibre in a vacuum system and the prepared fibre end-face is then coated with a metallic material such as Au, Ag, Al or Ti or a dielectric material such as $TiO_2$. This coating can be prepared by using thermal evaporation, electron beam evaporation or sputtering. Other coating or mirroring materials and techniques may also be utilised.

Preferably, but without limitation, the mirrored fibre end-face is fusion spliced or otherwise connected to the end of the sensing fibre on-site in the field during system installation. In other situations, the mirrored fibre end-face is produced or otherwise formed in the factory.

The distributed fibre optic sensing technique can operate at any suitable optical wavelength, such as 633 nm, 670 nm, 780 nm, 850 nm, 980 nm, 1310 nm, 1480 nm, 1550 $\mu$m or 1640 nm.

In some embodiments of the present invention, but without limitation, the distributed fibre optic sensing technique only is utilised in the system. However, in other embodiments, other or alternate sensing and/or communications systems may be operated in the same fibre or cable, at the same or different wavelengths, using suitable system components, optical fibres, etc., as well as appropriate time, wavelength, frequency and/or other multiplexing techniques, as required.

In other preferred embodiments, the transmissive counter-propagating signal method for locating events is employed, and suitable optical devices are employed at one or both ends of the system to detect the signals. Preferably, further silica waveguides are connected to the first silica waveguide at either or both ends in order to provide insensitive lead waveguides and, if applicable, to add additional delay between the transmissive counter-propagating signals.

In preferred embodiments of the present invention, without limitation, lead-in and lead-out fibre desensitisation and sensor localisation is achieved. In other embodiments it may be possible to have lead-in or lead-out sensitivity or no sensor localisation.

In preferred embodiments, the couplers are 2×1 or 2×2 couplers. In other embodiments they may be any suitable multi-port device, such as, 3×1, 4×2, etc. In other embodiments, the couplers may be replaced with alternate wavelength filtering, conditioning, combining, splitting or directing devices.

In other embodiments, a plurality of couplers and other suitable components are utilised in junction by-pass arrangements for the sensing signal in order to extend the sensing fibre length beyond one node or zone.

In preferred embodiments of the invention, but without limitation, all the optical fibres and fibre devices are connected by fusion splices. In other embodiments the optical fibres and fibre devices may be connected by any suitable or appropriate technique, such as mechanical splices, connectorised leads and through-adaptors, etc.

In preferred embodiments of the present invention, without limitation, the manufactured sensor and/or the exposed fusion spliced region may be protected by encapsulating or coating the desired region in fusion splice protectors or any suitable jackets or materials (ie. ultraviolet acrylate, epoxy, etc.).

In preferred embodiments of the present invention, without limitation, the detector means comprises:

a photodetector for receiving the transmitted or reflected radiation from the sensing signal in the sensing fibre; and processing means for receiving signals from the photodetector and analysing the signals in order to register the sensed events.

If the locating technique is utilised as well as the sensing technique, preferably the detector means comprises:

first and second photodetectors for simultaneously receiving the radiation from the counter-propagating signals in the sensing fibre; and processing means for receiving signals from the first and second photodetectors and analysing the signals in order to register the sensed events and determining the time delay or difference between the counter-propagating signals effected from the same disturbance, thus determining the location of the sensed events.

Preferably, the waveguide comprises at least one optical fibre and/or at least one optical fibre device.

In some embodiments of the invention the waveguide may merely comprise an optical fibre without any additional elements. However, the optical fibre can include passive or active elements along its length.

Furthermore, the optical fibre can include sensing elements along its length and those sensing elements can comprise devices which will respond to a change in the desired parameter in the environment of application and influence the properties and characteristics of the sensing electromagnetic radiation propagating in the waveguide to thereby provide an indication of the change in the parameter.

Preferably, any suitable CW or pulsed single or multiple wavelength source or plurality of sources may be employed. In a preferred embodiment, without limitation, a CW or pulsed coherent laser diode is utilised to supply the optical signal. In an alternate arrangement, multiple light sources, of the same or varying wavelengths, may be used to generate the sensing signal or a plurality of sensing signals.

The preferred embodiments of the present invention offer the potential to utilise all-fibre, low-cost optical devices in conjunction with laser diodes, light emitting diodes, photodetectors, couplers, WDM couplers, circulators, isolators, filters, etc. In the preferred embodiments of the present invention any suitable light source, coupler and photodetector arrangement may be used with the sensor and locating systems. In a preferred embodiment, the required optical properties of the light source are such that light may be launched into and propagated in the singlemode waveguide. For localisation, the light propagated in a singlemode fibre must remain singlemoded during the entire period of travel in the singlemode fibre. Once the light is launched into the multimode fibre from the singlemode fibre, several modes may be excited and the multimoded fibre will be sensitive to various parameters. Once the light is launched back into the singlemode fibre from the multimode fibre, only a single mode is supported and travels to the optical components of the system. Lead-in/lead-out fibre desensitisation and sensor localisation is achieved in this manner. In practical applications, the singlemode fibre should be made sufficiently long to attenuate all cladding modes in order to improve the signal-to-noise ratio. This preferred embodiment applies for both directions of travel of the transmissive counter-propagating optical signals, if this technique is utilised.

Utilisation of properties and characteristics of the electromagnetic radiation propagating in the waveguide sensor enables monitoring to take place in a non-destructive manner. Thus, the sensor is not necessarily damaged, fractured or destroyed in order to monitor and locate the desired parameters.

The effective sensing length of the waveguide sensors can be varied for either distributed or point sensitivity. Multi-zone or multi-point sensing can be achieved by quasi-distributed, distributed or multiplexed configurations.

Preferably, the sensing device and/or system instrumentation optical and electronic arrangements will utilise noise minimisation techniques.

Preferably, all the optical and electrical components will be located in a single instrument enclosure, with a number of suitable optical and electrical input/output ports. Preferably, the monitoring systems are microprocessor based, situated in a central control/alarm room and fully automated, providing real-time data analysis, logging and alarming features, and can be monitored and controlled locally or remotely. Optical devices, electro-optic devices, acousto-optic devices, magneto-optic devices and/or integrated optical devices may also be utilised in the system.

In preferred embodiments, but without limitation, the sensing waveguide is physically attached to each individual picket or panel of the fence or fence section to be monitored and the sensing waveguide detects any displacement, movement, loading and/or vibration of the monitored fence pickets or panels. In other embodiments, the sensing waveguide is physically attached to a number of the individual pickets or panels of the fence or fence section to be monitored and the sensing waveguide detects any displacement, movement, loading and/or vibration of the monitored fence pickets or panels.

In preferred embodiments, but without limitation, the sensing waveguide is physically attached to each individual picket or panel of the fence or fence section to be monitored such that localised bending or movement of the sensing waveguide is maximised, without damaging the waveguide. In other embodiments the sensing waveguide is physically attached to a number of individual pickets or panels of the fence or fence section to be monitored such that localised bending or movement of the sensing waveguide is maximised, without damaging the waveguide.

In preferred embodiments, but without limitation, specific configurations of picket or panel fences and mechanisms are used so as to facilitate attachment of the distributed physical disturbance sensing waveguide to each instrumented picket or panel of the desired fence perimeter.

In preferred embodiments of the invention, but without limitation, the fence is constructed with metal pickets and support members. In other embodiments, the fence can be made from any other suitable material. In other embodiments, the fence can be made from panels, slabs, solid brick, concrete or any other suitable construction made from any set or combination of appropriate materials and supporting infrastructure. In preferred embodiments of the invention, but without limitation, the monitored fence is free-standing. In other embodiments, the monitored fence arrangement is designed to be mounted on the top, sides and/or the inside of the fence or supporting infrastructure.

In preferred embodiments of the invention, but without limitation, the entire fence is monitored. In other embodiments, only parts of or sections of a fence are monitored.

In preferred embodiments of the invention, any form or style of picket can be employed with any suitable form of fence. In some embodiments combinations of different forms or styles of pickets are employed.

In preferred embodiments, but without limitation, attachment of the distributed sensing waveguides to the desired number of pickets or panels in a perimeter fence arrangement is in a zoned fashion (ie., a number of monitored zones to cover a perimeter).

In other preferred embodiments, but without limitation, attachment of the distributed sensing waveguides to the desired number of pickets or panels in a perimeter fence arrangement is in a continuous fashion (ie., one complete length, loop or other suitable arrangement).

In preferred embodiments, but without limitation, the monitoring systems incorporate instrumentation capable of real-time data logging, analysing and alarming of the signals from the sensing devices and displaying and/or transmitting the information in a suitable manner.

In preferred embodiments of the invention, but without limitation, the monitoring system is a microprocessor based and fully automated instrument that can be monitored and controlled locally and/or remotely.

Preferably, the system instrumentation comprises hardware and software components.

In a preferred embodiment of the invention, but without limitation, the installed sensing devices are calibrated by a suitable process involving disturbing the instrumented pickets or panels a number of times, varying the disturbance a number of ways, to establish statistically derived calibration factors for the monitored perimeter.

In a preferred embodiment of the invention, but without limitation, each monitoring system contains at least one sensing waveguide. In some embodiments, a plurality of sensing waveguides may be used. In yet other embodiments a plurality of varying types of sensors may be utilised.

In preferred embodiments of the invention, but without limitation, the inventions disclosed in this specification may be used for screening or enforcement applications.

BRIEF DESCRIPTION OF THE DRAWINGS

Preferred embodiments of the present invention will be further illustrated, by way of example, with reference to the following drawings in which:

FIG. 12 is a view of a general embodiment of a short section of the base extrusion according to the present invention;

FIGS. 13*a* and 13*b* show a base extrusion and a picket according to one embodiment of the present invention;

DETAILED DESCRIPTION OF THE PREFERRED EMBODIMENTS

Figure 1:
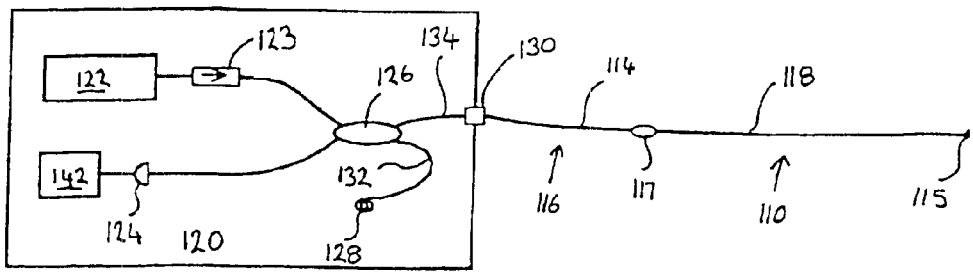
FIG. 1 shows a fibre optic modalmetric interferometer, in a reflective configuration, which is utilised as the distributed fibre optic vibration sensor of one embodiment of the present invention.

Preferred embodiments of the invention, without imposing any limitations, will be further described with reference to the above mentioned drawings. The drawings and the following embodiments are provided in as general a form as possible to avoid confusion. While it may not be specifically stated or illustrated in the following embodiments and drawings, in the preferred embodiments the following features are utilised, and not intentionally omitted, where appropriate:

- the distributed sensing technique is based on a modalmetric distributed fibre optic vibration sensor technique;
- the transmissive counter-propagating signal method for locating events is employed, where appropriate, and suitable optical devices are employed at one or both ends of the system to detect and process the signals;

further silica fibres are connected to the main sensing fibre at either or both ends in order to provide insensitive lead fibres and, if applicable, to add additional delay between the transmissive counter-propagating signals;

any suitable light source, coupler and photodetector arrangement may be used with the sensor and locating systems. In a preferred embodiment, the required optical properties of the light source are such that light may be launched into and propagated in a singlemode fibre. For localisation, the light propagated in a singlemode fibre must remain singlemoded during the entire period of travel in the singlemode fibre. Once the light is launched into the multimode fibre from the singlemode fibre, several modes may be excited and the multimoded fibre will be sensitive to various parameters. Once the light is launched back into the singlemode fibre from the multimode fibre, only a single mode is supported and travels to the optical components of the system. Lead-in/lead-out fibre desensitisation and sensor localisation is achieved in this manner. In practical applications, the singlemode fibre should be made sufficiently long to attenuate all cladding modes in order to improve the signal-to-noise ratio. This preferred embodiment applies for both directions of travel of the transmissive counter-propagating optical signals where this technique is utilised;

suitable electrical and/or optical devices are employed at one or both ends of the system to detect and process the signals;

utilisation of properties and characteristics of the light propagating in the fibre sensor enables monitoring to take place in a non-destructive manner. Thus, the sensor is not necessarily damaged, fractured or destroyed in order to monitor or locate the desired parameters;

utilisation of all-fibre, low-cost optical devices in conjunction with laser diodes, photodetectors, couplers, WDM couplers, isolators, circulators, filters, etc.;

the couplers are 2×2 3 dB couplers, in other embodiments they may be any suitable multi-port device, such as 2×1, 3×1, 3×3, 4×4, etc.;

the optical fibres and fibre devices are connected by fusion splices. In other embodiments the optical fibres and fibre devices are connected by any suitable or appropriate technique, such as mechanical splices, connectorised leads and through-adaptors, etc.; a panel is considered to be a discrete section, of any length, of fencing; and the base extrusion referred to in the figures consists of a channel extrusion in which the monitored pickets, panels or supporting members of the fence are installed in and attached to. In the preferred embodiments, the distributed sensing device is housed inside the base extrusion and attached to the desired number of pickets or panels to be monitored, as will be illustrated in the figures. The base extrusion may be mounted horizontally or vertically, and may not necessarily be at the base of the fence or monitored pickets or panels.

FIG. 1 shows a general embodiment of the fibre optic modalmetric interferometer, in a reflective configuration, which is utilised as the distributed fibre optic vibration sensor of the preferred embodiment of the present invention. With reference to FIG. 1, according to a preferred embodiment of the invention, a fibre optic modalmetric sensor 110 comprises a multimode fibre 118 which is mirrored on it's end-face 115 and fusion spliced 117 to a jacketed singlemode fibre lead 116 which includes a singlemode fibre 114. The free end of the fibre optic modalmetric sensor 110 formed by fibre 118 is the part of the waveguide sensor that should be exposed to the sensing region of interest (ie., suitably attached to the desired fence pickets or panels). The singlemode fibre lead 116 is coupled to sensing device instrumentation 120, which includes singlemode fibre pigtailed light source 122, isolator 123, coupler 126 and a photodetector 124 and electronic components 142. The output arm 132 of the coupler 126 is unused and is fractured or otherwise terminated 128 to avoid back-reflections. Thus, the laser light continues to propagate along only one of the output arms 134 of the coupler 126. The output arm 134 of the coupler 126 is then terminated at a singlemode fibre optic bulkhead connector (through adaptor) 130. The jacketed, connectorised singlemode fibre lead 116 is connected to the through adaptor 130, such that the light from the output arm 134 of the coupler 126 is launched into the fibre lead 116. The light source 122 provides light which is propagated along the singlemode fibre 114 in the singlemode fibre lead 116 and, which in the embodiment of FIG. 1, is reflected back along the optical fibres 118 and 114 for detection by the photodetector 124. The propagated light in the multimode fibre 118, which is eventually detected by the detector unit 124, has its properties and characteristics altered by a displacement, movement, loading and/or vibration experienced by the sensing fibre 118.

Figure 2:
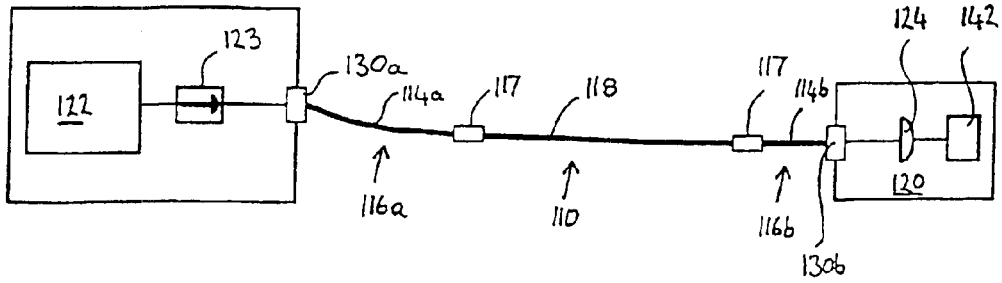
FIG. 2 is a view showing a fibre optic modalmetric interferometer, in a transmissive configuration, which is utilised as the distributed fibre optic vibration sensor of another embodiment of the present invention.
Figures 3A, 3B, 3C, 3D, 3E, 3F, 3G:
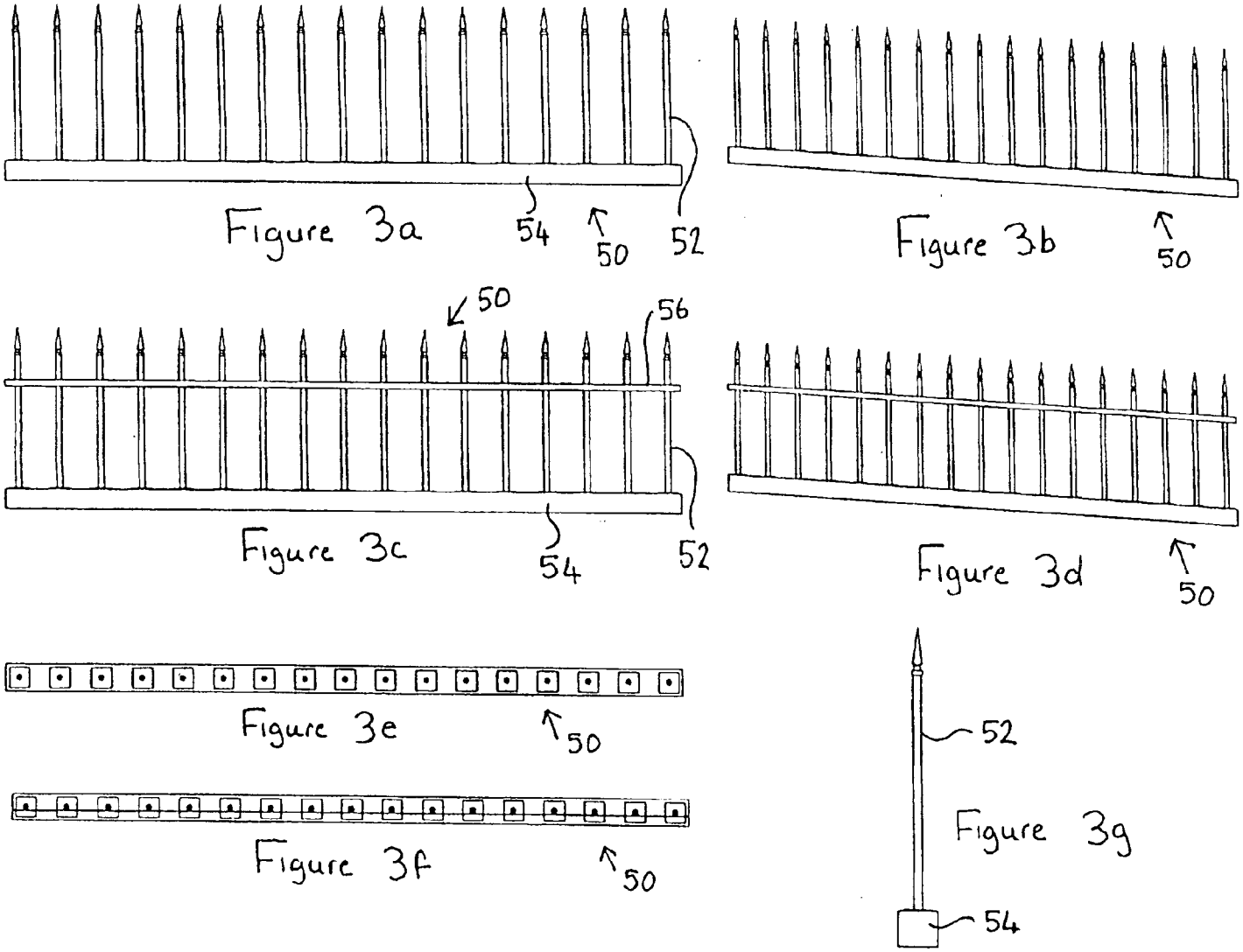
FIGS. 3*a*, 3*b*, 3*c*, 3*d*, 3*e*, 3*f* and 3*g* show a side view of a fence embodying the invention, a view of a sloping fence embodying the invention, a view of a fence including a crossbar, a view of sloping fence including a crossbar, a plan view of the fence of FIG. 3*a*, a plan view of the fence of FIG. 3*c* and an end view of the fence of FIG. 3*a* respectively.

FIG. 2 shows a general embodiment of the fibre optic modalmetric interferometer, in a transmissive configuration, which is utilised as the distributed fibre optic vibration sensor of another embodiment of the present invention. With reference to FIG. 2, according to a preferred embodiment of the invention, a fibre optic modalmetric sensor 110 comprises a multimode fibre 118 which is fusion spliced 117 to singlemode fibre leads 116*a* and 116*b* at both ends of the sensing fibre 118. The length of the multimode fibre 118 is the part of the waveguide sensor that should be exposed to the sensing region of interest (ie., suitably attached to the desired fence pickets or panels). The singlemode fibre lead 116*a* is coupled to singlemode fibre pigtailed light source 122 and isolator 123. The laser light is launched into a singlemode fibre pigtail and is then terminated at a singlemode fibre optic bulkhead connector (through adaptor) 130*a*. A jacketed, connectorised singlemode fibre lead 116*a* is connected to the through adaptor 130*a*, such that the light from the singlemode fibre pigtailed light source 122 and isolator 123 is launched into the fibre lead 116*a*. Thus, the light source 122 provides light which is propagated along the singlemode fibre 114*a* in the singlemode fibre lead 116*a* and, which in the embodiment of FIG. 2, is propagated through sensing fibre 118 to a second singlemode fibre 114*b* in the singlemode fibre lead 116*b*. The jacketed, connectorised singlemode fibre lead 116*b* is then terminated at a singlemode fibre optic through adaptor 130*b* for detection by the photodetector 124. The singlemode fibre lead 116*b* is thus coupled to sensing device instrumentation 120, which includes a photodetector 124 and electronic components 142. The propagated light in the multimode fibre 118, which is eventually detected by the detector unit 124, has its properties and characteristics altered by a displacement, movement, loading and/or vibration experienced by the sensing fibre 118.

FIGS. 3*a* to 3*g* show embodiments of metal picket fence configurations according to the present invention, having individual monitored pickets with or without the use of a crossbar. According to the general embodiment, a panel 50 is defined as a discrete section, of any length, of fencing. In this general embodiment, individual pickets 52 are mounted in a base extrusion 54, with or without the use of a crossbar 56, in such a manner as to be firmly held in place, and yet so that physical disturbance of the monitored pickets 52 or panels 50 of the monitored fence produces suitable movement of the pickets 52 or panels 50 to be detected by the distributed sensing device of the present invention. In this embodiment, the distributed sensing device is housed inside the base extrusion 54 and attached to the desired number of pickets 52 or panels 50 to be monitored, as will be illustrated in further figures. In the embodiment of FIG. 4, if an intruder attempts to cut through or climb over the monitored fence panels 50, the instrumented pickets 52 or panels 50 will be physically disturbed, which will be detected by the distributed sensing device and an alarm will be raised. The embodiments of the instrumented picket fence shown may be of a free-standing or fence mounted type.

Figure 4A:
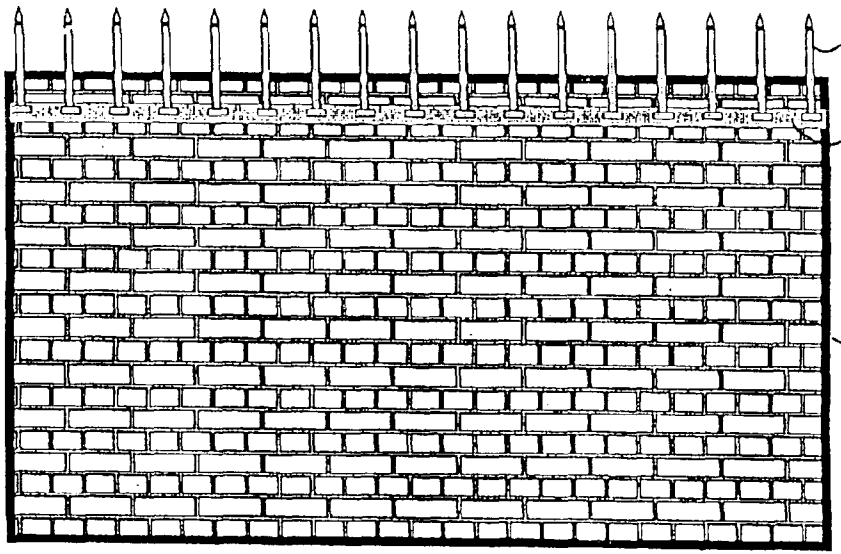
FIGS. 4*a*, 4*b* and 4*c* show a front view of a brick fence embodying the invention, a side view of the fence of FIG. 4*a* and a perspective view of the fence of FIG. 4*a* respectively.
Figure 4C:
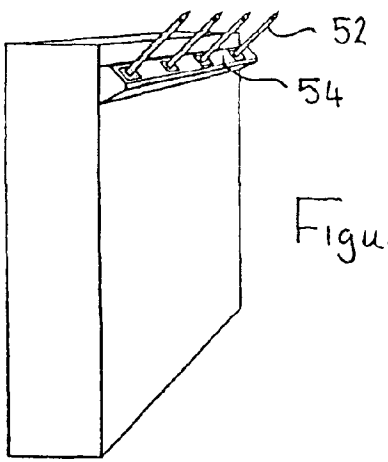
Figure 4B:
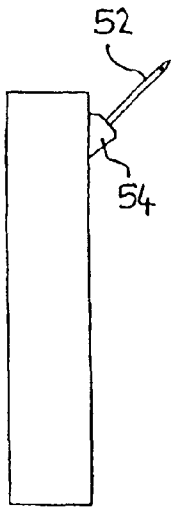

FIGS. 4*a* to 4*c* show a further general embodiment of the present invention. In the embodiment of FIG. 4, an instrumented panel 50 is attached to the side of a monitored brick fence 60. In this configuration, metal pickets 52 are mounted in a base extrusion 54 attached to the side of a solid brick fence 60 to be monitored. The pickets 52 may be vertical or angled (as shown) and configured such that physical disturbance of the monitored pickets 52 or panels 50 of the monitored fence produces suitable movement of the pickets 52 or panels 50 so as to be detected by the distributed sensing device of the present invention. The distributed sensing device is housed inside the base extrusion 54 and attached to the desired number of pickets or panels to be monitored. In the embodiment of FIG. 5, if an intruder attempts to climb over the monitored fence 60, the instrumented pickets 52 or panels 50 will be physically disturbed, which will be detected by the distributed sensing device and an alarm will be raised.

Figure 5A:
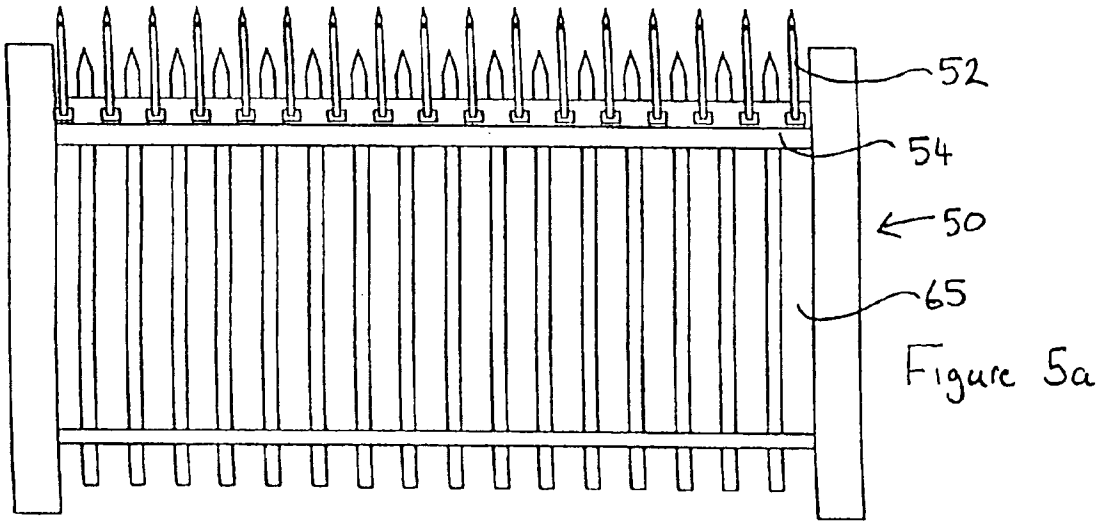
FIGS. 5*a* and 5*b* show a front view and perspective view of a fence panel according to yet a further embodiment.
Figure 5B:
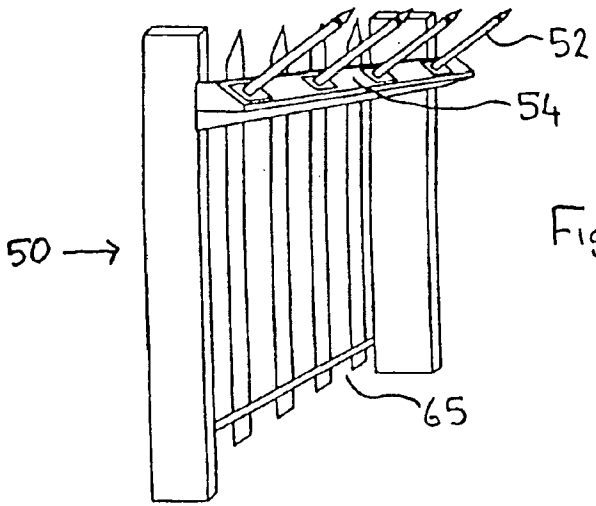

FIGS. 5*a* and 5*b* show another general embodiment of the present invention. In the embodiment of FIGS. 5*a* and 5*b*, an instrumented panel 50 is attached to the side of a monitored palisade fence 65. In this configuration, metal pickets 52 are mounted in a base extrusion 54 attached to the side of a palisade fence 65 to be monitored. The pickets 52 may be vertical or angled (as shown) and configured such that physical disturbance of the monitored pickets 52 or panels 50 of the monitored fence produces suitable movement of the pickets 52 or panels 50 so as to be detected by the distributed sensing device of the present invention. The distributed sensing device is housed inside the base extrusion 54 and attached to the desired number of pickets or panels to be monitored. In the embodiment of FIG. 5, if an intruder attempts to climb over the monitored fence 65, the instrumented pickets 52 or panels 50 will be physically disturbed, which will be detected by the distributed sensing device and an alarm will be raised.

Figure 6B:
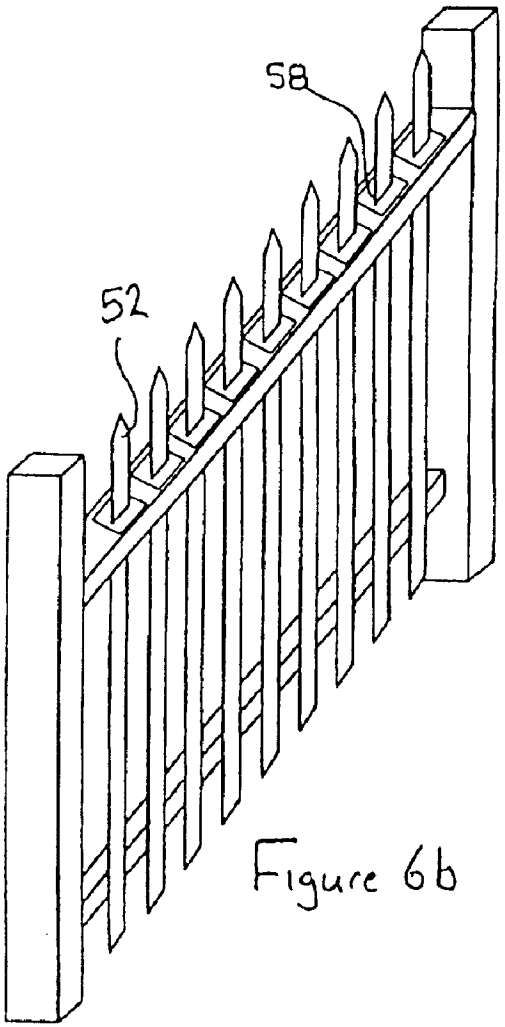
FIGS. 6*a* and 6*b* are a front view and perspective view of a picket fence panel according to a still further embodiment.
Figure 6A:
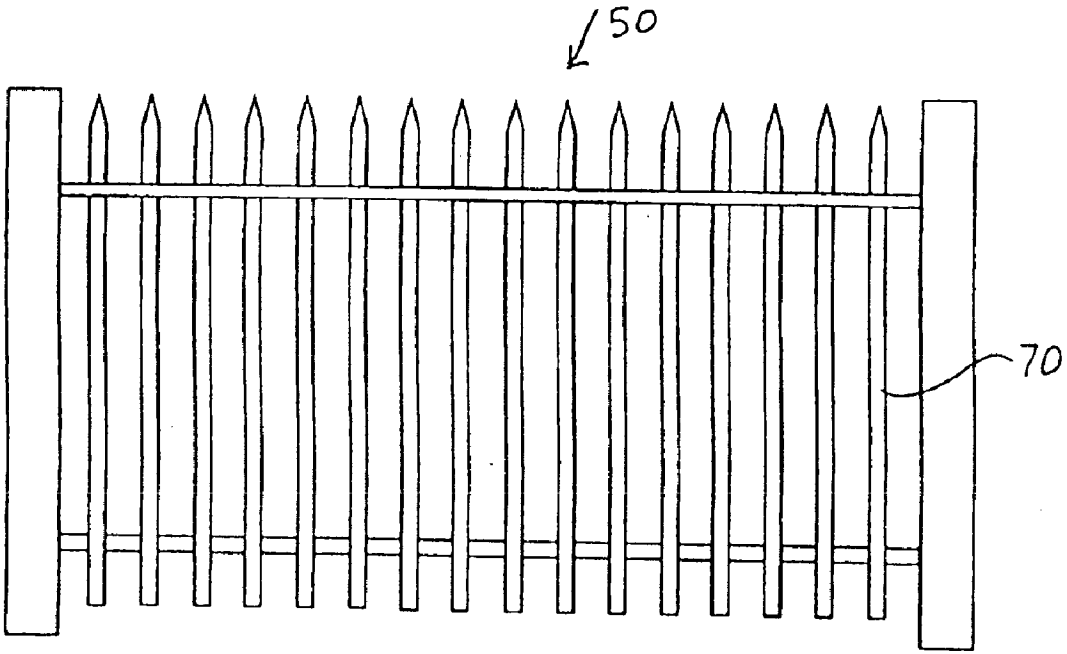

FIGS. 6*a* and 6*b* show yet another general embodiment of the present invention. In this embodiment, an instrumented panel 50 is constructed from the pickets of a palisade fence 70. In this configuration, the palisade pickets 52 are inserted through an extrusion housing 58 which is mounted near the top of the palisade fence 70 to be monitored. The pickets 52 may be vertical (as shown) or angled. The system is configured such that physical disturbance of the monitored pickets 52 or panels 50 of the monitored fence produces suitable movement of the pickets 52 or panels 50 so as to be detected by the distributed sensing device of the present invention. The distributed sensing device is housed inside the extrusion housing 58 and attached to the desired number of pickets or panels to be monitored. In the embodiment of FIG. 6, if an intruder attempts to cut through or climb over the monitored fence 70, the instrumented pickets 52 or panels 50 will be physically disturbed, which will be detected by the distributed sensing device and an alarm will be raised. In the embodiment of FIG. 6, it is also possible to fix the palisade pickets 52 rigidly below the extrusion housing 58 and have only the tops of the pickets 52 free to move. However, this configuration would not likely detect an intruder cutting through the lower part of the fence.

Figure 7:
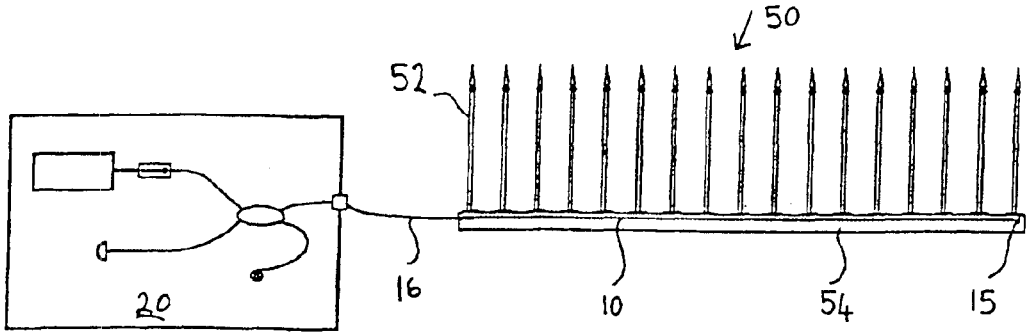
FIG. 7 is a view of a general embodiment of the present invention illustrating a monitored fence utilising methods according to FIGS. 1 to 4.

FIG. 7 is a view of a general embodiment of the present invention illustrating a monitored fence utilizing methods according to FIGS. 1 and 3. In the embodiment of FIG. 7, sensing device instrumentation 20, according to FIG. 1, is used to launch a sensing signal through singlemode fibre lead 16, to the sensing fibre 10 of the sensing device. Sensing fibre 10 is housed inside the base extrusion 54 of the fence panel 50 and attached to the desired number of pickets 52 or panels 50 to be monitored. The sensing signal is reflected at mirrored end 15 and returns to the sensing device instrumentation 20, through singlemode fibre lead 16, to be detected and processed in sensing device instrumentation 20. Singlemode fibre lead 16 is generally protected and hidden by running it in conduits to the sensing device instrumentation 20. The sensing fibre 10, which is capable of detecting displacement, movement, loading and/or vibration is thus capable of detecting and monitoring all movement or physical disturbance to the fence. The sensing system analyses the signal characteristics using suitable algorithms, taking into account any site calibration factors, so as to determine the likelihood of the detected event being an attempted intrusion or tampering of the perimeter barrier of the monitor perimeter and determining whether to raise an alarm. In the embodiment of FIG. 7, therefore, if an intruder attempts to cut through or climb over the monitored fence panels 50, the instrumented pickets 52 or panels 50 will be physically disturbed, which will be detected by the distributed sensing device and an alarm will be raised.

Figure 8:
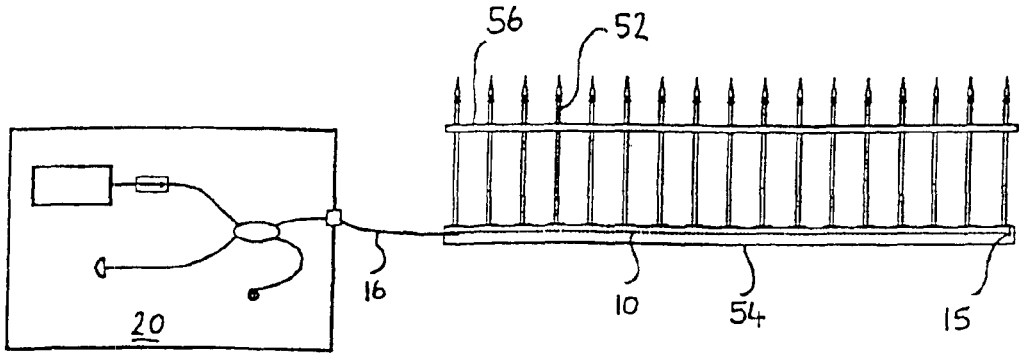
FIG. 8 is a view of another general embodiment of the present invention

FIG. 8 is a view of another general embodiment of the present invention according to FIG. 7. The only difference in this case is the use of a crossbar 56 on the pickets 52, which tends to spread-out the disturbance across a number of pickets 52.

Figure 9:
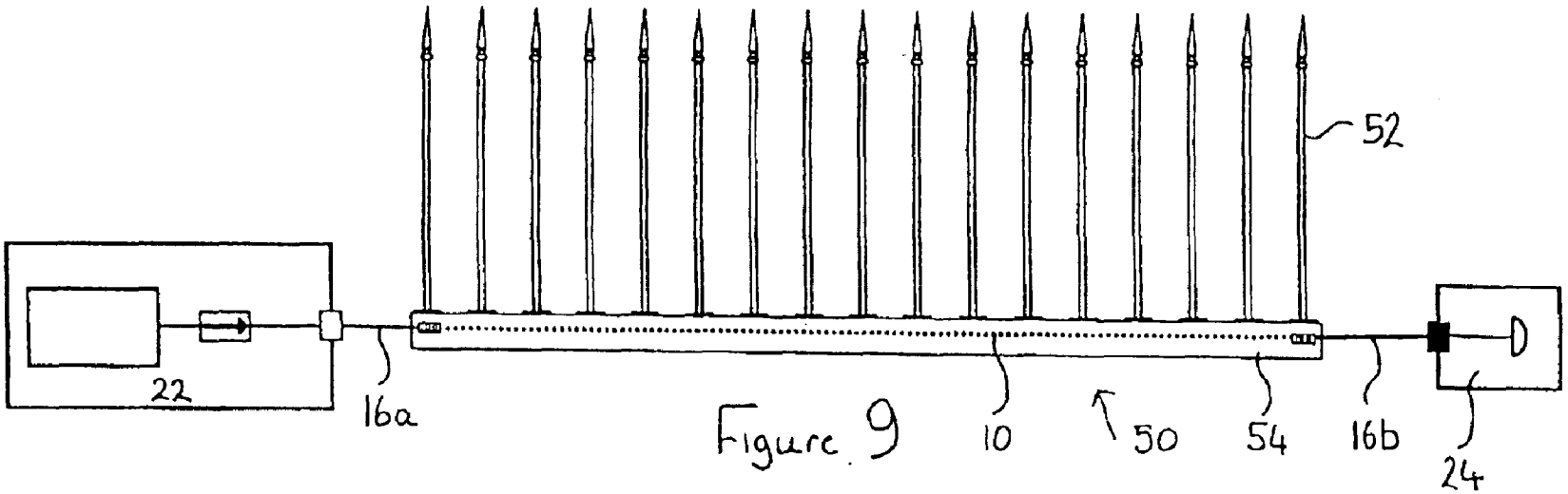
FIG. 9 is a view of a general embodiment of the present invention illustrating a monitored fence utilising methods according to FIGS. 2 and 4.

FIG. 9 is a view of a general embodiment of the present invention illustrating a monitored fence utilizing methods according to FIGS. 2 and 3. In the embodiment of FIG. 9, light at a sensing wavelength is launched from transmitting section 22, according to FIG. 2, into singlemode fibre lead 16*a*, through the sensing fibre 10 and through to a second singlemode fibre lead 16*b*. Sensing fibre 10 is housed inside the base extrusion 54 of the fence panel 50 and attached to the desired number of pickets 52 or panels 50 to be monitored. Thus the sensing signal propagates through to the sensing device instrumentation 24, through singlemode fibre lead 16*b* to detected and processed in sensing device instrumentation 24. Singlemode fibre leads 16*a* and 16*b* are generally protected and hidden by running them in conduits. The sensing fibre 10, which is capable of detecting displacement, movement, loading and/or vibration is thus capable of detecting and monitoring all movement or physical disturbance to the fence. The sensing system analyses the signal characteristics using suitable algorithms, taking into account any site calibration factors, so as to determine the likelihood of the detected event being an attempted intrusion or tampering of the perimeter barrier of the monitored perimeter and determining whether to raise an alarm. In the embodiment of FIG. 9, therefore, if an intruder attempts to cut through or climb over the monitored fence panels 50, the instrumented pickets 52 or panels 50 will be physically disturbed, which will be detected by the distributed sensing device and an alarm will be raised.

Figure 10:
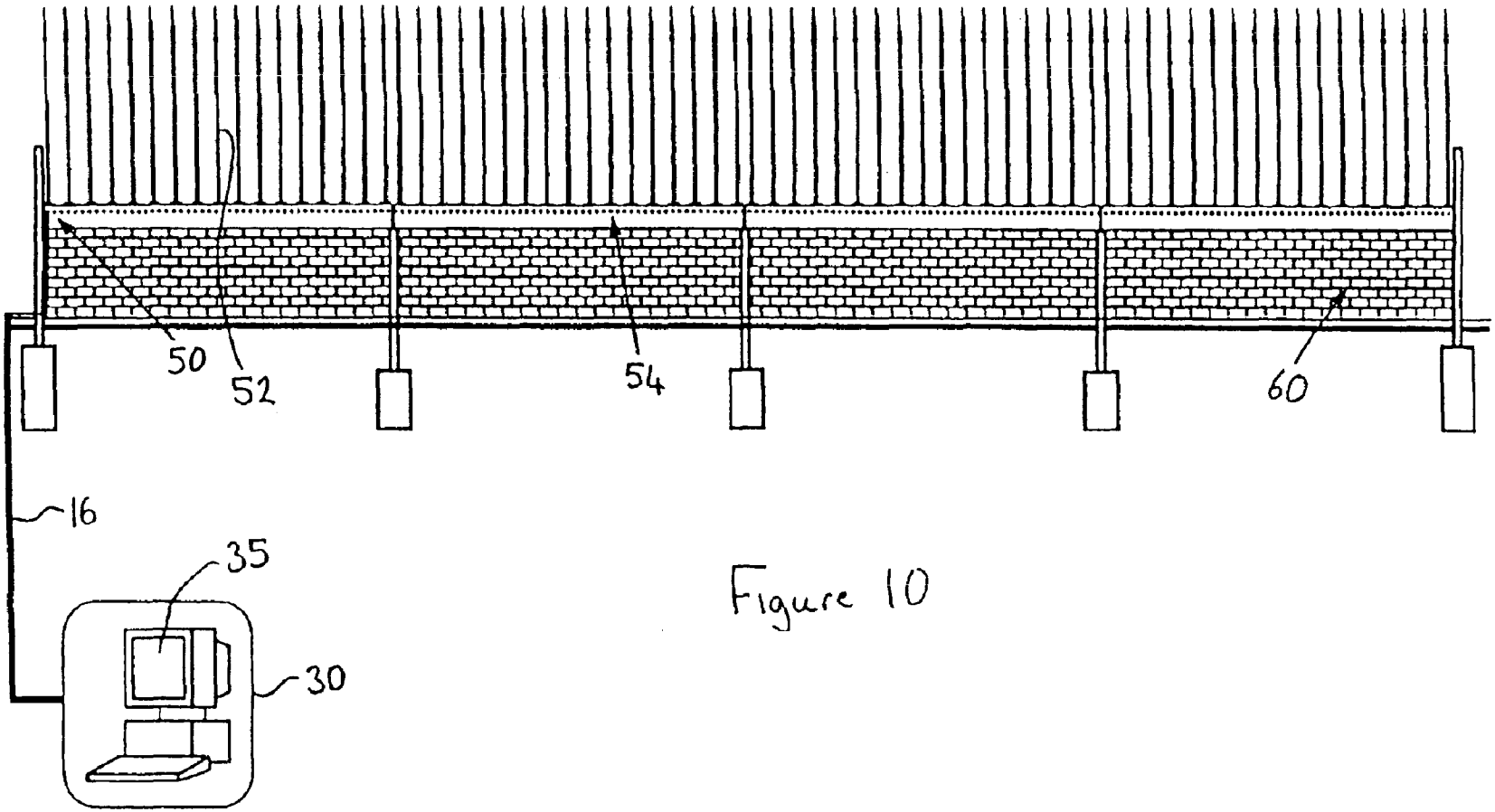
FIG. 10 is a view of a general embodiment of the present invention illustrating a complete system for an instrumented steel picket fence on top of a solid brick wall fence and a continuous sensing configuration to cover four fence panels, utilising methods according to FIGS. 1 and 3.

FIG. 10 is a view of a general embodiment of the present invention illustrating a complete system for an instrumented steel picket fence on top of a solid brick wall fence and a continuous sensing configuration to cover four fence panels, utilising methods according to FIGS. 1 and 3. With reference to FIG. 10, according to a preferred embodiment of the present invention, sensing device instrumentation housed in system instrumentation 30 is used to launch a sensing signal though singlemode fibre lead 16, to the sensing fibre 10 of the sensing device. Sensing fibre 10 is housed inside a series of base extrusions 54 of the fence panels 50, mounted in a suitable fashion to the top of a solid brick fence 60, and attached to the desired number of pickets 52 or panels 50 to be monitored. The sensing signal is reflected at mirrored end 15 and returns to the sensing device instrumentation housed in system instrumentation 30, through singlemode fibre lead 16, to be detected and processed in sensing device instrumentation and in system instrumentation 30. Singlemode fibre lead 16 is generally protected and hidden by running it in conduits to the sensing device instrumentation housed in system instrumentation 30. The sensing fibre 10, which is capable of detecting displacement, movement, loading and/or vibration is thus capable of detecting and monitoring all movement or physical disturbance to the fence. The sensing system analyses the signal characteristics using suitable algorithms, taking into account any site calibration factors, so as to determine the likelihood of the detected event being an attempted intrusion or tampering of the perimeter barrier of the monitored perimeter and determining whether to raise an alarm. System instrumentation 30 houses the sensing device instrumentation, as well as all the appropriate electronics, signal processing schemes and algorithms required to process the signals from the various sensors. Preferably, all the optical and electrical components will be located in a single instrument enclosure, with a number of suitable optical and electrical input/output ports. In the embodiment of FIG. 10, the sensing system is microprocessor based, situated in a central control/alarm room and fully automated, providing real-time data analysis, logging and alarming features, and can be monitored and controlled locally or remotely. In the embodiment of FIG. 10, therefore, if an intruder attempts to cut through or climb over the monitored fence panels 50, the instrumented pickets 52 or panels 50 will be physically disturbed, which will be detected by the distributed sensing device and an alarm will be raised. When an alarm is raised, the system instrumentation may also provide a visual display 35 of the alarm conditions, as shown in the figure.

Figure 11:
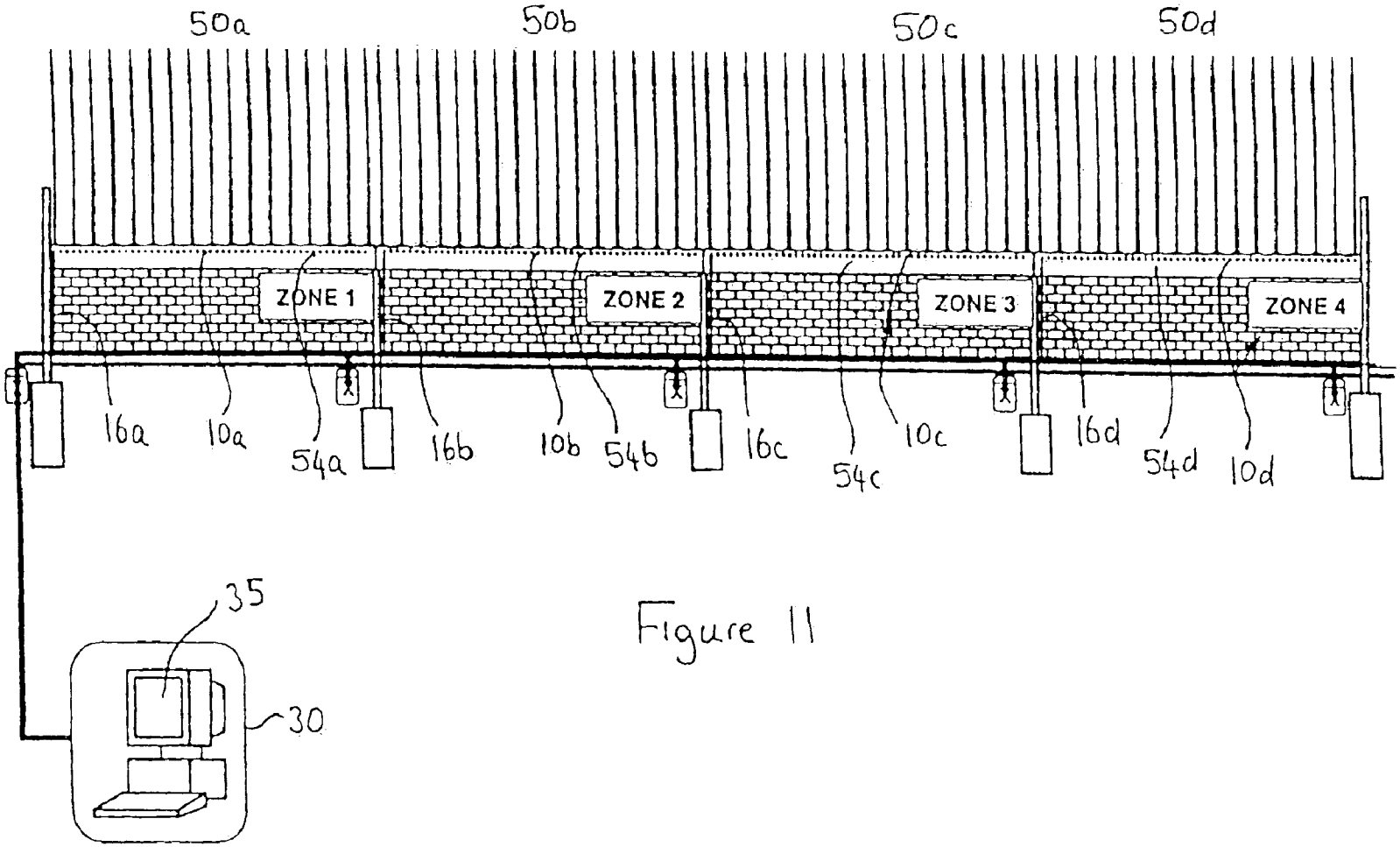
FIG. 11 is a view of another general embodiment of the present invention illustrating a complete system for an instrumented steel picket fence on top of a solid brick wall fence and a multiplexed four-zone sensing configuration to cover four individual fence panels.

FIG. 11 is a view of another general embodiment of the present invention illustrating a complete system for an instrumented steel picket fence on top of a solid configuration to cover four individual fence panels 50*a*, 50*b*, 50*c* and 50*d*. This embodiment is similar to that described in FIG. 10, except that the sensing system is multiplexed to provide four individual sensing zones 16*a*, 16*b*, 16*c* and 16*d* along the monitored fence rather than one continuous length covering all four zones. In this embodiment individual leads 10*a*, 10*b*, 10*c* and 10*d* extend back to visual display 35 from individual base extrusions 54*a*, 54*b*, 54*c* and 54*d*.

FIG. 12 is a view of a general embodiment of a short section of the base extrusion according to the present invention. With reference to FIG. 12, according to a preferred embodiment of the present invention, the base extrusion 54 is constructed from a suitable channel extrusion 400 designed specifically to hold a series of pickets firmly in place in such a manner so that physical disturbance of the monitored pickets 52 or panels 50 of the monitored fence produces suitable movement of the pickets 52 or panels 50 to be detected by the distributed sensing device of the present invention. The pickets are inserted into a specific diameter hole 402 and optionally stopped from rotating by a suitable nib or protruding bolt 404. The channel extrusion 400 is mounted to the fence structure in any suitable or appropriate fashion or location and bolted into place using mounting tabs 406 located at suitable intervals along the length of the channel extrusion 400. In the preferred embodiments, the distributed sensing device is housed inside the base extrusion 54 and attached to the desired number of pickets 52 or panels 50 to be monitored.

FIGS. 13*a* and 13*b* show a general embodiment of a picket for monitoring according to the present invention. With reference to FIGS. 13*a* and 13*b*, according to a preferred embodiment of the present invention, the picket 52 is constructed from any suitable material and style or form of picket 410 such that it may be mounted in a base extrusion 54 in such a manner as to be firmly held in place, and yet so that physical disturbance of a monitored picket 52 produces suitable movement of the picket 52 to be detected by the distributed sensing device of the present invention. The top 412 of the picket 52 may be uncapped or capped with any desirable object. The end-shape of the picket 52 is such that it can fit suitably into the specific diameter hole 402 on the surface 401 of the extrusion 54 shown in FIG. 12. A washer 414 shown in FIG. 13*b* of appropriate shape and material is welded or otherwise attached onto the picket 52, perpendicular to the picket 410 and with minimum distortion to the washer 414, at a desired height of the picket 52 in order to facilitate mounting the picket 410 in the base extrusion 54 such that a desired length of the picket 52 is inserted into the surface 401 of extrusion 54 and a desired length extends out from the surface 401. Two suitable diameter holes 418 and 419 are drilled on the surface of the washer 414. One hole 418 is used to fit over the nib 404 on the base extrusion 54 in order to prevent the picket 52 from rotating. The second hole 419 is tapped and used with an adjustable screw for elevating one side of the picket 52 in situations where the picket 52 needs to be aligned at a particular angle. Furthermore, any suitable number of holes 416 of appropriate diameter are drilled through the picket 52 to facilitate mounting of a rod which is used for mounting the distributed sensing device, as seen detailed in FIG. 15.

Figure 14:
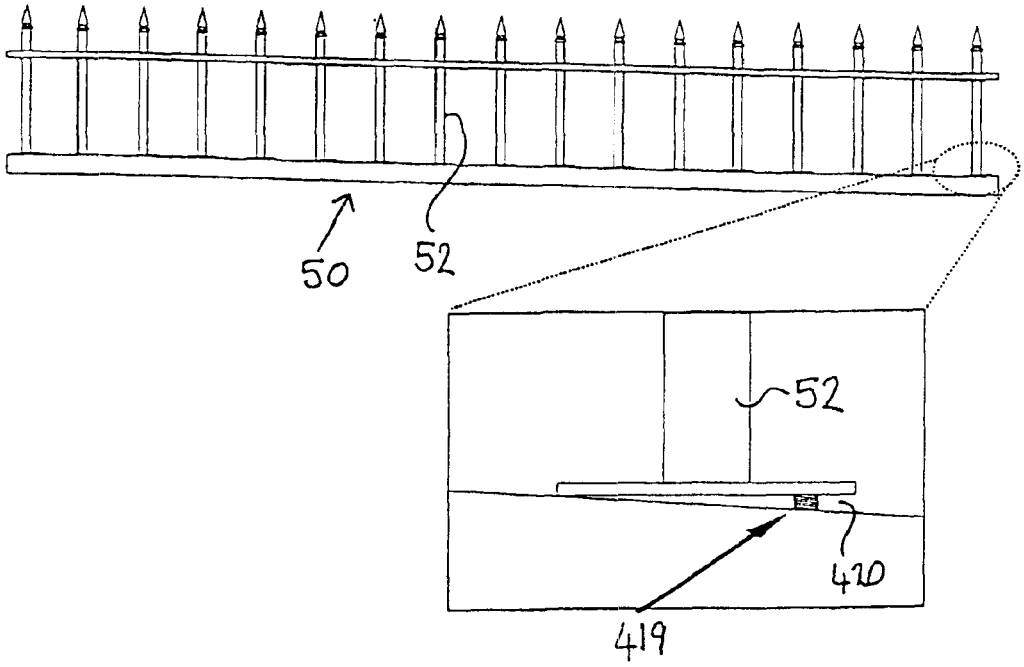
FIG. 14 is a view of a general embodiment of the technique for aligning pickets on a sloping fence according to the present invention.

FIG. 14 is a view of a general embodiment of the technique for aligning pickets on a sloping fence according to the present invention. With reference to FIG. 14, according to a preferred embodiment of the present invention, a drilled and tapped hole 419 is used with an adjustable screw 420 for elevating one side of the pickets 52 in situations where the pickets 52 need to be aligned at a particular angle.

Figure 15:
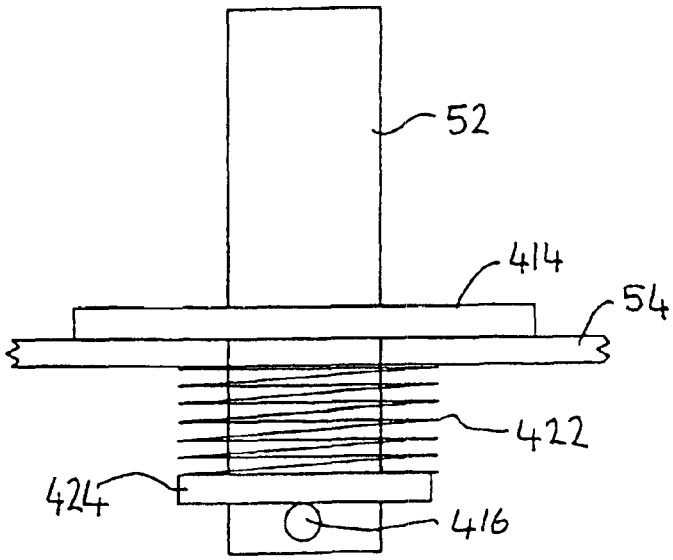
FIG. 15 is a cross-sectional side view of the method for picket installation in the base extrusion according to the present invention.

FIG. 15 is a cross-sectional side view of the method for picket installation in the base extrusion according to the present invention. With reference to FIG. 15, according to a preferred embodiment of present invention, the picket 52 is mounted in the base extrusion 54, through the hole 402 on the surface 404 of the extrusion 54, such that a desired length of the picket 52 is inserted through the surface 404 and a desired length extends out from the surface 404. A suitable diameter compressing spring 422 and a washer 424 are slipped over the picket 52 end-face (in the base extrusion 54) and pressure is applied to compress the spring 422 so as to enable a rod to be inserted into one of the holes 416. The rod is used for mounting the distributed sensing device, as seen in FIG. 10. The force applied by the <spring thus firmly holds the picket 52 onto the base extrusion 54. The height of the hole 416 determines the stiffness at which the picket 52 is held onto the base extrusion 54 and, therefore, effects the amount of force or movement needed to physically disturb the picket 52 such that the physical disturbance can be detected by the distributed sensing device of the present invention. Any suitable number of holes 416 and/or washers 424 may be used to facilitate convenient adjustment of the picket 52 stiffness in the field installation of a system.

Figure 16A:
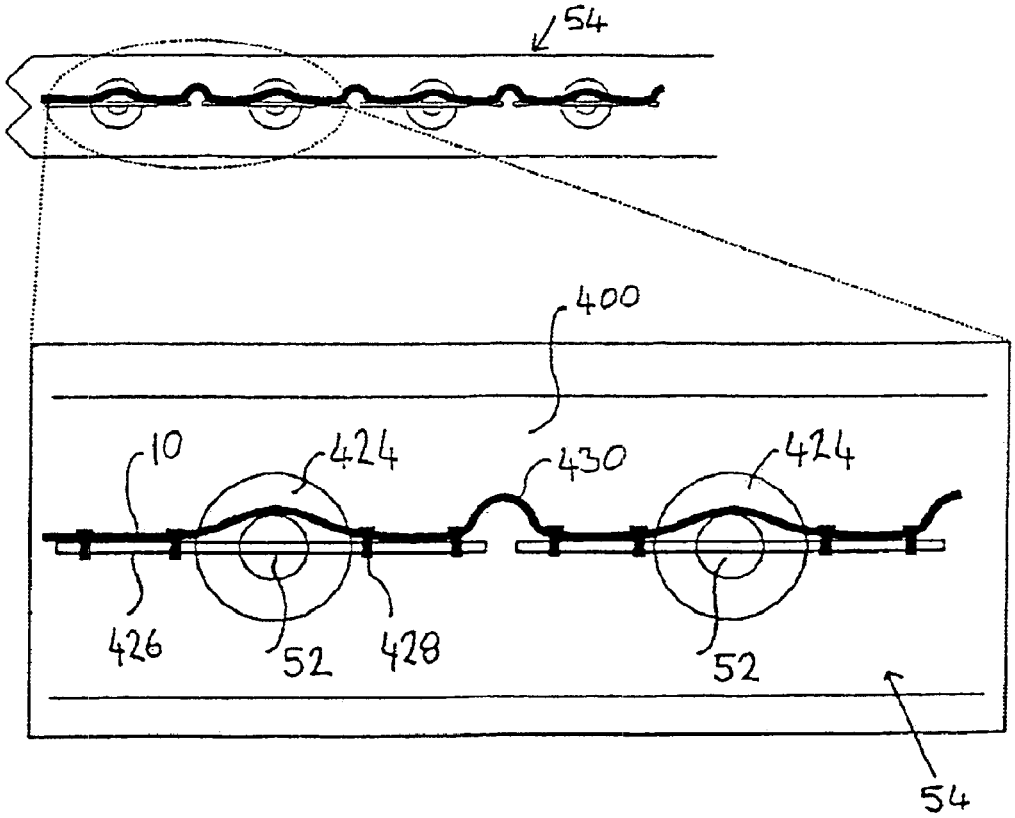
FIGS. 16*a* and 16*b* show a bottom view and a cross-sectional side view of the method for picket installation in the base extrusion according to one embodiment of the present invention.
Figure 16B:
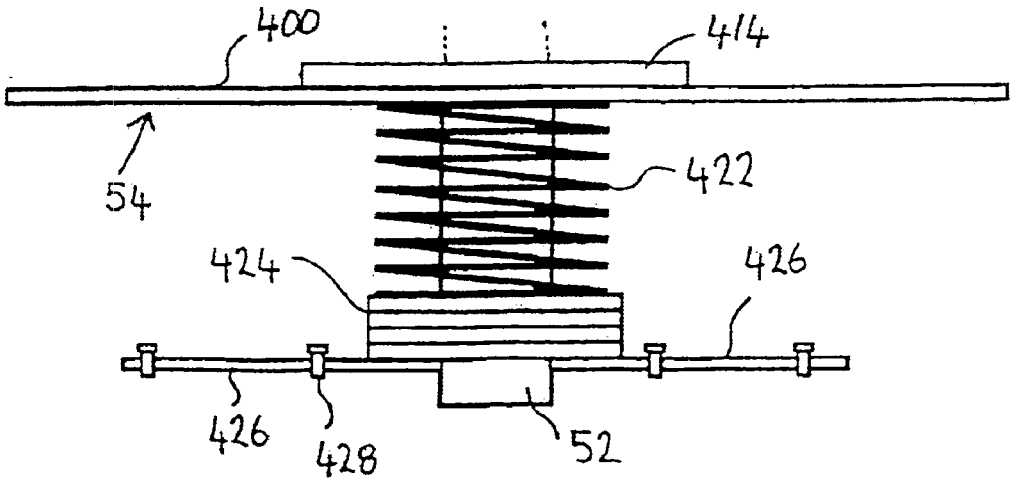

FIG. 16 shows a bottom view and cross-sectional side view of the method for picket installation in the base extrusion 54 according to the present invention. With reference to FIG. 16, according to a preferred embodiment of the present invention, the picket 410 is mounted in the base extrusion 54, through the hole 402 on the surface 401, such that a desired length of the picket 52 is inserted into the base extrusion 54 and a desired length extends out from the surface 401. A suitable diameter compressing spring 422 and a washer 424 are slipped over the picket 52 end-face (in the channel base extrusion 54) and pressure is applied to compress the spring 422 so as to enable a rod 426 to be inserted into hole 416. The rod 426 is used for mounting the distributed sensing fibre 10 (which can be formed by any one of the fibres 118 described which refer to FIGS. 1 to 3) onto the picket 52 to be monitored. The force applied by the spring thus firmly holds the picket 52 onto the base extrusion 54. The height of the hole 416 determines the stiffness at which the picket 52 is held onto the base extrusion 54 and, therefore, effects the amount of force or movement needed to physically disturb the picket 52 such that the physical disturbance can be detected by the distributed sensing device of the present invention. Any suitable number of holes 416 and/or washers 424 may be used to facilitate convenient adjustment of the picket 52 stiffness in the field installation of a system. The distributed sensing fibre 10 is physically attached to the rods 426 by cable ties 428 or any other suitable means such that localized movement, in the form of bending 430, of the distributed sensing fibre 10 is maximized, without damaging the fibre.

Figure 17:
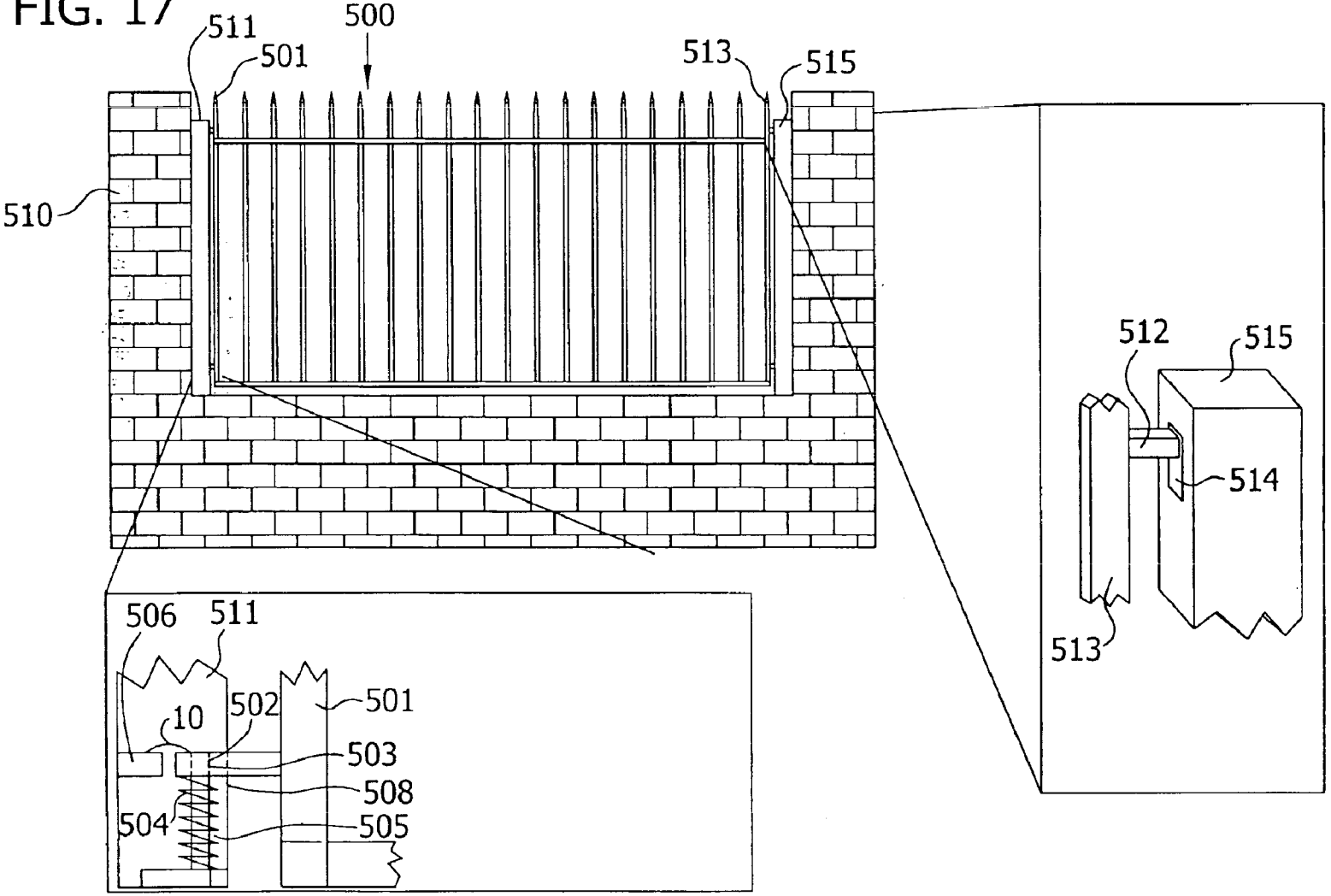
FIG. 17 is a view showing a further general embodiment of the present invention.
Figure 18:
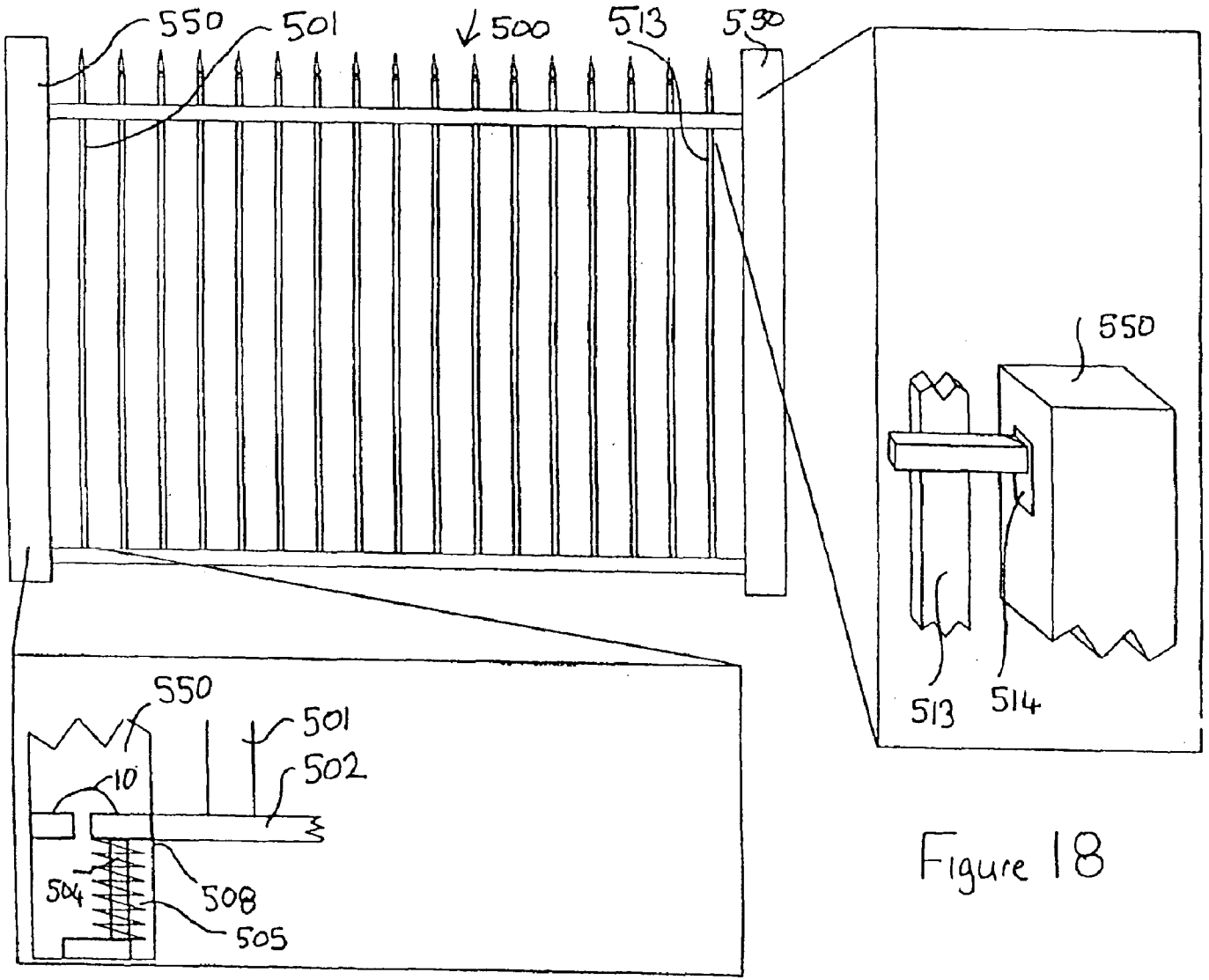
FIG. 18 is a view showing yet a further general embodiment of the present invention.

FIGS. 17 and 18, further general embodiments of the present invention are illustrated. In these embodiments, an entire panel is monitored, rather than the individual pickets, by mounting channel extrusions vertically on the ends of the panels and utilising the general embodiment described in FIGS. 1S and 16 on the horizontal support members of the panel to detect and monitor physical disturbance and/or movement of the panel.

As shown in FIG. 17 a panel 500 formed from pickets is mounted within a brick structure 510. End picket is mounted within a brick structure 510. End picket 501 of the panel 500 has an arm 502 which has hole 503 which a rod 504 is provided. A spring 505 is provided around the rod 504 and is supported on a rail 506. The arm 502 extends through a slot 508 provided in support post 511. The top of the panel 500 is supported in a similar way by an arm 512 connected to picket 513 with the arm 512 being spring mounted in a similar fashion to the arm 502 and being moveable through a slot at 514 in end post 515. The fibre 10 is supported on a support rail 506 and on arm 502. The fibre extends to and from adjacent panels 500 (not shown) and is supported on rails 506 and arms 502 adjacent these panels 500 in the same manner as shown in FIG. 17. Thus a continuous fibre 10 can extend along all fence panels 500 which make up the fence. If any attempt is made to climb over the panel 500 the panel 500 will move against the bias of springs 505 causing movement of the fibre 10 and thereby the provision of a signal indication a breach of a perimeter.

FIG. 18 shows a similar arrangement to that of FIG. 17. In this embodiment the panel 500 is mounted between posts 550 rather than a brick structure as in the embodiment of FIG. 17.

In the embodiment of FIGS. 17 and 18 arm 512 which is arranged at the top of the fence panels 500 may be spring biased in the same manner as the arm 502 at the bottom of the fence panels 500. However, in other arrangements the arm could simply be guided for facilitating vertical movement of the fence panel 500 with the springs 505 at the bottom of the panels supporting the panels 500 and allowing slight movement of the panels 500 if an attempt is made to climb over the panels.

Obviously in the embodiments of FIGS. 17 and 18, if a person climbs over the brick structure 510 the fibre 10 will not be disturbed. Depending on the degree of security required, the structure 510 could be omitted so that the fence panels 500 are effectively continuous, or the structure 510 could be made very thin so that it would not be possible to climb over them without making some contact with the panels 500 which would disturb the panels and thereby move the fibre 10 to produce a signal indicative of an attempted breach.

As shown in FIGS. 17 and 18 the fibre 10 bows or bends slightly as it extends from the rail 506 to the support arm 502 so as to facilitate movement in the production of a signal indicative of breach in the same manner as described with reference to FIG. 16.

An important aspect of the preferred embodiments of the invention described previously is that the sensing techniques disclosed are distributed sensing techniques which can detect a disturbance at any point along the optical fibre 10. Thus a movement, such as a bending, of any part of the fibre will cause a change in parameter of the light signal which will be detected by the detector thereby indicating an attempted breach of the perimeter barrier system. This enables the fibre to be installed in the manner described in the preferred embodiments and for sensing to take place at any point along the fibre without any additional sensing elements or mechanical structures. Thus, the present embodiments can therefore be used to sense individual picket movement, or panel movement as previously described. This is because of the fact that sensing can take place at any point along the length of fibre and is not restricted to the use of fibre clamping or other mechanical devices to cause a microbending which results in sensing at only discrete points along the length of the fibre where the devices are located onto the fibre.

Applications of the Preferred Embodiments

Directed discussions with industry have verified that there is very good commercial potential for the disclosed inventions and that there are clear advantages over the prior-art. It is important to note that the technology is considered to have good potential over competing techniques particularly because of the ease of sensor installation, the increased sensitivity and coverage, the excellent potential for system automation (ie., using cameras and remote communications) and the reduction in the required installation, operational and maintenance costs. Therefore, the inventions disclosed in this specification potentially offer lower cost products with enhanced capabilities and features. Not inclusively, but indicatively, the following examples illustrates some applications in which a system according to the present invention may be used:

Detection and monitoring of intrusion or breach of a barrier

Detection and monitoring of intrusion or breach of a perimeter

Detection and monitoring of intrusion or breach of a site

Detection and monitoring of intrusion or breach of an installation

Detection and monitoring of intrusion or breach of a location

Detection and monitoring of people

Detection and monitoring of animals

Detection and monitoring of vehicles

Detection and monitoring of objects

Potential sites for the application of the disclosed monitoring systems include:

- National borders
- International borders
- Coastlines
- Military installations/buildings
- Defence installations/buildings
- Government installations/buildings
- Industrial installations/buildings
- Prisons
- Power plants
- Nuclear power and processing plants
- Roadways and barriers
- Industrial, plant and factory sites
- Rail yards
- Airports
- Buried pipelines
- Chemical laboratories
- Pumping stations
- Embassies
- Secure residential complexes
- Manufacturing plants
- Storage facilities
- Communications facilities
- Harbours Potential clients for the disclosed monitoring systems include:

- Security firms
- Industrial, plant and factory Owners/operators
- Law enforcement authorities
- Correctional facilities owners/operators
- Defence authorities
- Government agencies
- Insurance firms
- Communications firms
- Power generation/distribution firms
- Pipeline operators/owners
- Road authorities
- Transport firms and operators
- Private road ventures
- Rail authorities and freight operators
- Airport authorities Since modifications within the spirit and scope of the invention may readily be effected by persons skilled within the art, it is to be understood that this invention is not limited to the particular embodiments described by way of example hereinabove.

What is claimed is:

1. A perimeter barrier system comprising:

a barrier element;

a mounting for mounting the barrier element for intentional limited movement, the mounting having a biasing system for biasing the barrier element towards a first position, and wherein upon a disturbance of the barrier element caused by an attempt to breach the perimeter barrier system, the barrier element moves intentionally against the bias of the biasing system towards a second position;

a waveguide located in proximity to the barrier element;

a light source for launching light into the waveguide so that the light can travel through the waveguide;

a detector for detecting light which has traveled through the waveguide; and wherein upon the disturbance, the barrier element moves towards the second position to cause a movement or loading of the waveguide which alters a parameter of the light traveling through the waveguide, and whereupon the detector detects the changing parameter of the light which has traveled through the waveguide to thereby provide an indication of an attempted breach of the perimeter barrier system.

2. The perimeter barrier system of claim 1 wherein the waveguide comprises an optical fibre.

3. The perimeter barrier system according to claim 1 wherein the waveguide is supported on a waveguide support member attached to the perimeter barrier system.

4. The perimeter barrier system of claim 3 wherein the waveguide support member comprises a rod connected to the barrier element so that the waveguide extends along the rod and is connected to the rod so that the rod holds the waveguide in contact with the barrier element.

5. The perimeter barrier system according to claim 4 wherein the rod passes through a hole through the barrier element.

6. The perimeter barrier system according to claim 5 wherein the waveguide is coupled to the rod by cable ties, and the waveguide loops around the barrier element so as to be in contact with the barrier element.

7. The perimeter barrier system according to claim 4 wherein a plurality of waveguide support elements are connected one each to a respective one of a plurality of said barrier elements, a common waveguide being connected to the plurality of waveguide support elements and the waveguide being in contact with each of the barrier elements, portions of the waveguide which extend between respective waveguide support members having a localized bend to facilitate movement of the waveguide upon movement of one of the barrier elements during an attempt to breach the perimeter barrier system.

8. The perimeter barrier system according to claim 1 wherein the barrier element comprises a segment of a fence.

9. The perimeter barrier system according to claim 8 wherein the segment of the fence comprises at least a plurality of pickets of the fence.

10. The perimeter barrier system according to claim 8 wherein the segment of the fence comprises a fence panel of the fence.

11. A perimeter barrier system according to claim 1 wherein the mounting comprises a mounting support element for receiving the barrier element, the biasing system comprising at least one spring for biasing the barrier element to the first position into engagement with the mounting element so that an attempt to breach the perimeter barrier system causes the barrier element to be moved against the bias of the at least one spring to the second position to in turn move the waveguide.

12. The perimeter barrier system according to claim 1 wherein the barrier element comprises a plurality of pickets, each picket having a flange member, the mounting having an opening through which the picket passes so that the mounting engages the flange member to support a picket, a second flange element moveably mounted on each picket, the biasing system comprising a respective spring disposed between the second flange element and the flange member and in contact with the second flange element for biasing the flange member and the mounting together, a hole in each picket, a waveguide support element located in the holes so as to hold the second flange element on the pickets and apply bias to the springs so that the springs hold the flange member and the mounting together at the first position.

13. The perimeter barrier system according to claim 1 wherein the barrier element comprises a fence panel, the biasing system comprising at least one spring for biasing the fence panel into engagement with the mounting at the first position, means for holding the at least one spring in a tensioned condition so that the spring pushes against the panel, and said waveguide being coupled to the holding means and in proximity to part of the panel so that when the panel is moved against the tension of the at least one spring towards the second position, the waveguide is moved to thereby provide an indication of an attempted breach of the perimeter system.

14. A perimeter barrier system according to claim 1 wherein the light source, waveguide and detector form a fibre optic modalmetric interferometer for detecting the change in parameter of the light to alert an attempted breach of the perimeter barrier system.

15. The perimeter barrier system according to claim 1 wherein the detector comprises a photodetector for receiving light which is passed through the waveguide and processing means for receiving signals from the photodetector and analyzing the signals in order to determine a change in parameter of the light to provide an indication of a disturbance indicating an attempt to breach the perimeter barrier system.

16. The perimeter barrier system according to claim 1, where the waveguide forms a distributed sensing waveguide which, upon movement of the waveguide at any point along the length of the waveguide causes a change in the parameter of the light transmitted through the waveguide.

17. A method of monitoring a perimeter barrier system to determine an attempt to breach the perimeter barrier system, comprising:

mounting barrier elements of the perimeter barrier system for intentional limited movement against the bias of a biasing system;

providing a waveguide in proximity to the barrier elements so that movement of the barrier elements upon an attempt to breach the barrier element causes movement or loading of the waveguide;

detecting light which is passed through the waveguide; and processing the detected light to determine whether there is a change in parameter of the light indicative of movement of the waveguide which in turn is indicative of movement of one of the barrier elements to thereby provide an indication of an attempted breach of the perimeter barrier system.

18. The method of claim 17 wherein the step of processing the detected light includes the step of modalmetric interferometric processing of detected light to determine the change in parameter of the light.

19. The method according to claim 17 wherein the waveguide comprises at least one optical fibre.

20. The method according to claim 17 where the waveguide forms a distributed sensing waveguide which can cause a change in the parameter of the light upon movement if the waveguide at any point along the length of the waveguide.

* * * * *